US011724300B2

(12) United States Patent
Schwartz

(10) Patent No.: US 11,724,300 B2
(45) Date of Patent: Aug. 15, 2023

(54) DIE SHOE ASSEMBLIES CONFIGURED FOR SHIMLESS ADJUSTMENT

(71) Applicant: Wilson Tool International Inc., White Bear Lake, MN (US)

(72) Inventor: Anthony David Schwartz, Forest Lake, MN (US)

(73) Assignee: WILSON TOOL INTERNATIONAL INC., White Bear Lake, MN (US)

( * ) Notice: Subject to any disclaimer, the term of this patent is extended or adjusted under 35 U.S.C. 154(b) by 81 days.

(21) Appl. No.: 17/179,807

(22) Filed: Feb. 19, 2021

(65) Prior Publication Data

US 2022/0266327 A1 Aug. 25, 2022

(51) Int. Cl.

| | |
|---|---|
| ***B21D 37/12*** | (2006.01) |
| ***B21D 28/34*** | (2006.01) |
| ***B21D 37/04*** | (2006.01) |

(52) U.S. Cl.

CPC ..... *B21D 37/12* (2013.01)

(58) Field of Classification Search

CPC ..... B21D 37/10; B21D 37/12; B21D 37/04; B21D 28/34; B21D 28/343; B21D 28/346; B21D 37/00; B21D 37/14

USPC ..... 72/446

See application file for complete search history.

(56) References Cited

U.S. PATENT DOCUMENTS

| | | | | |
|---|---|---|---|---|
| 2,199,864 | A | 5/1940 | Wehr | |
| 2,456,856 | A | 12/1948 | Bath | |
| 3,685,380 | A * | 8/1972 | Daniels | B21D 28/12 83/552 |
| 4,571,979 | A | 2/1986 | Baba et al. | |
| 4,615,204 | A | 10/1986 | Yamamoto et al. | |
| 4,736,612 | A | 4/1988 | Russell | |
| 5,131,303 | A * | 7/1992 | Wilson | B26F 1/14 83/699.41 |
| 5,176,017 | A | 1/1993 | Tokai | |
| 6,499,330 | B1 | 12/2002 | Pelech, Jr. | |
| 7,229,263 | B2 | 6/2007 | Silbermann et al. | |
| 8,443,646 | B2 | 5/2013 | Pelech | |
| 9,481,026 | B2 | 11/2016 | Ciocirian et al. | |
| 2012/0279369 | A1* | 11/2012 | Kimura | B21D 28/12 83/563 |
| 2017/0304887 | A1 | 10/2017 | Kohno | |

FOREIGN PATENT DOCUMENTS

| | | | | |
|---|---|---|---|---|
| CN | 207013554 U | 2/2018 | | |
| JP | 2000218326 A * | 8/2000 | | B26F 1/14 |

OTHER PUBLICATIONS

English translate(JP2000218326A), retrieved date Jul. 1, 2022.*

PCT International Search Report and Written Opinion dated May 16, 2022 for related Intl. App. No. PCT/US2022/016095, 11 pgs.

* cited by examiner

*Primary Examiner* — Matthew Katcoff
*Assistant Examiner* — Mohammed S. Alawadi
(74) *Attorney, Agent, or Firm* — Fredrikson & Byron, P.A.

(57) ABSTRACT

Various designs of die shoe assemblies are provided, each assembly configured to adjust vertical positioning of a die platform within the assembly, in order to correspondingly adjust vertical positioning of a die used with the assembly. The assemblies address limitations often associated with conventional die shoes designed to be used with shims. The assemblies use various methods and corresponding mechanisms to make the adjustment a time efficient process, while in so doing also enabling the desired extent of adjustment to be effectively and accurately provided.

23 Claims, 26 Drawing Sheets

DIE SHOE ASSEMBLIES CONFIGURED FOR SHIMLESS ADJUSTMENT

FIELD OF THE INVENTION

The invention relates to punch press tooling, and more particularly to apparatus meant to contain a die portion of a punch and die tool set, whether in a loading cartridge or in an operating position of a press machine.

BACKGROUND

Many developments have been introduced over the years relative to metal-fabricating presses and the tool sets used therewith. These metal-fabricating presses would include turret presses and single-station presses. Turret presses, for example, involve a rotatable upper table or "turret" that carries a plurality of tools (e.g., punches), and a rotatable lower table/turret adapted to carry, for example, a plurality of dies. When the upper and lower tables are rotated into a position where a particular male punch on the upper table is aligned with a particular female die on the lower table, a workpiece (e.g., a piece of sheet metal) between the two can be machined (punched, bent, etc.) by moving the punch downward into contact with the workpiece so that the punch deforms the workpiece. The downward movement of the punch is caused when a ram strikes an upper part thereof. In some cases, a hole is punched in the workpiece during the down stroke of the punch, whereby the tip of the punch may shear through the sheet metal (and in the process, extend into a central recess of the die). Single station presses do not have a turret, but rather one station adapted for pressing workpieces. Non-turret, multiple-station presses can also use tool sets.

In processing a workpiece (e.g., a piece of sheet metal), it is common to use several different tool sets, that is, punch and die combinations. In some cases, once a first tool set has been used, it is exchanged for a second tool set, and then a third, and so on. Once a first workpiece has been fully processed using the desired sequence of tool sets, a second workpiece may be processed, in some cases beginning again with the first tool set.

The tool sets used on a machine tool can often be stored in cartridges. Some cartridges may be stored in the machine tool, while others may be kept nearby. When several different tool sets (e.g., of different size and/or shape) are used for a job, the machine tool is commonly provided with cartridges respectively holding the different tool sets. Not only do the cartridges store the tools, they may also be used to facilitate loading and unloading the tools on the machine tool. As is known with such cartridges, a die is held therein via a die shoe, with the die shoe and corresponding die being simultaneously loaded onto the machine tool.

Over its life, a die typically needs to be sharpened, which reduces the overall height of the die. Following such sharpening processes, a conventional method of adjusting the die's height (in a die shoe) has involved using shims. Particularly, one or more shims can be positioned between the die and die shoe, such that the top surface of the die (and an appreciable underlying layer thereof) is raised back to a height (relative to the die shoe) warranted for machining. However, the use of shims in this manner can bring delay to the overall machining process, relative to set-up. Additionally, there can be uncertainty with zeroing in on a new machining height for the die in the die shoe, and the corresponding adjustment in vertical positioning of the die that is warranted. With respect to using shims, this uncertainty may lead to a few individual shims or shim combinations being tried before arriving at that height; again, this represents further time lost in the process.

Embodiments described herein are concerned with addressing the above-noted issues and others.

SUMMARY OF THE INVENTION

Embodiments described herein focus on various designs of die shoe assemblies, and methods of their use. These assemblies are each configured to adjust vertical positioning of a die platform within the assembly, in order to correspondingly adjust vertical positioning of a die used with the assembly. The assemblies address limitations often associated with conventional die shoes designed to be used with shims. To that end, the assemblies use various methods and corresponding mechanisms to make the adjustment a time efficient process, while in so doing also enabling the desired adjustment to be effectively and accurately provided.

In certain embodiments of the invention, a die shoe assembly is provided. The assembly comprises a guide plate, a base, and a die platform. The guide plate defines a plurality of apertures therein and the base defines a plurality of recesses therein. The guide plate is adjoined atop the base with the apertures and recesses being aligned and sized to receive a corresponding plurality of die platforms. The die platforms are adjustably coupled within corresponding of the recesses and selectively adjustable to differing vertical positions as warranted relative to the base and the guide plate. The die platforms are sized to support dies received within corresponding of the apertures. At least one of the die platforms is selectively adjustable via use of a mechanism. The mechanism is configured to adjust the at least one die platform via a single action, whereby the single action results in a corresponding adjustment in vertical position of the at least one die platform and a corresponding adjustment in vertical position of the die supported by the at least one die platform.

In additional embodiments of the invention, a die shoe assembly is provided. The assembly comprises a guide plate, a base, and a die platform. The guide plate defines a plurality of apertures therein and the base defines a plurality of recesses therein. The guide plate is adjoined atop the base with the apertures and recesses being aligned and sized to receive a corresponding plurality of die platforms. The die platforms are threadedly received within corresponding of the recesses and selectively adjustable to differing vertical positions as warranted relative to inner threading defining the recesses. The die platforms are sized to support dies received within corresponding of the apertures. At least one of the die platforms is selectively adjustable via use of a mechanism. The mechanism when rotated resulting in corresponding rotation of the at least one die platform within the inner threading, wherein a defined extent of rotation of the mechanism represents a quantifiable iteration of adjustment in vertical position of the at least one die platform relative to the base and the guide plate.

In further embodiments of the invention, a method of adjusting vertical position of a die used in a die shoe assembly is provided. The method includes a step of providing a die shoe assembly including a guide plate, a base, and one or more die platforms. The guide plate defines a plurality of apertures therein and the base defines a plurality of recesses therein. The guide plate is adjoined atop the base with the apertures and recesses being aligned and sized to receive a corresponding plurality of the die platforms, wherein the die platforms are adjustably coupled within corresponding of the recesses. The method further includes a step of selectively adjusting a mechanism engaged to at least one of the die platforms to correspondingly adjust the at least one die platform to a warranted vertical position relative to the base and the guide plate.

DETAILED DESCRIPTION

Figure 1:
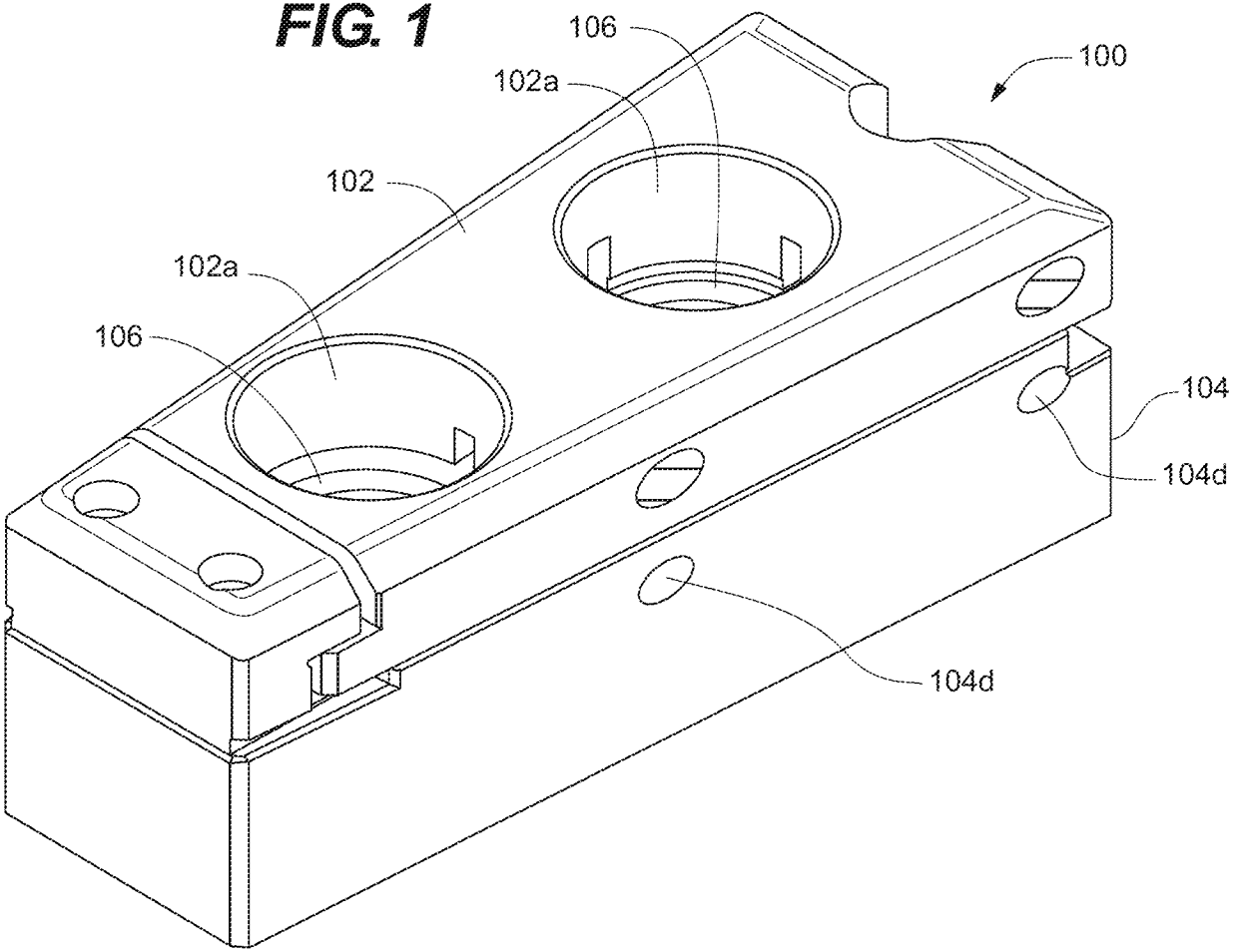
FIG. 1 is a perspective side view of a die shoe assembly in accordance with certain embodiments of the invention, with the assembly configured and shown for a first station type.

The following detailed description should be read with reference to the drawings, in which like elements in different drawings are numbered identically. The drawings depict selected embodiments and are not intended to limit the scope of the invention. It will be understood that embodiments shown in the drawings and described below are merely for illustrative purposes and are not intended to limit the scope of the invention as defined in the claims.

As already noted, embodiments described herein are concerned with various designs of die shoe assemblies, each assembly configured to adjust vertical positioning of a die platform therein, in order to correspondingly adjust vertical positioning of a die used with the assembly. Consequently, the machining lifetime of the die can be extended. The embodied die shoe assemblies address limitations often associated with conventional die shoes designed to be used with shims. To that end, the assemblies use various methods and corresponding mechanisms to make the die platform adjustment a time efficient process, while at the same time enabling the desired adjustment to be effectively and accurately provided.

Figure 2:
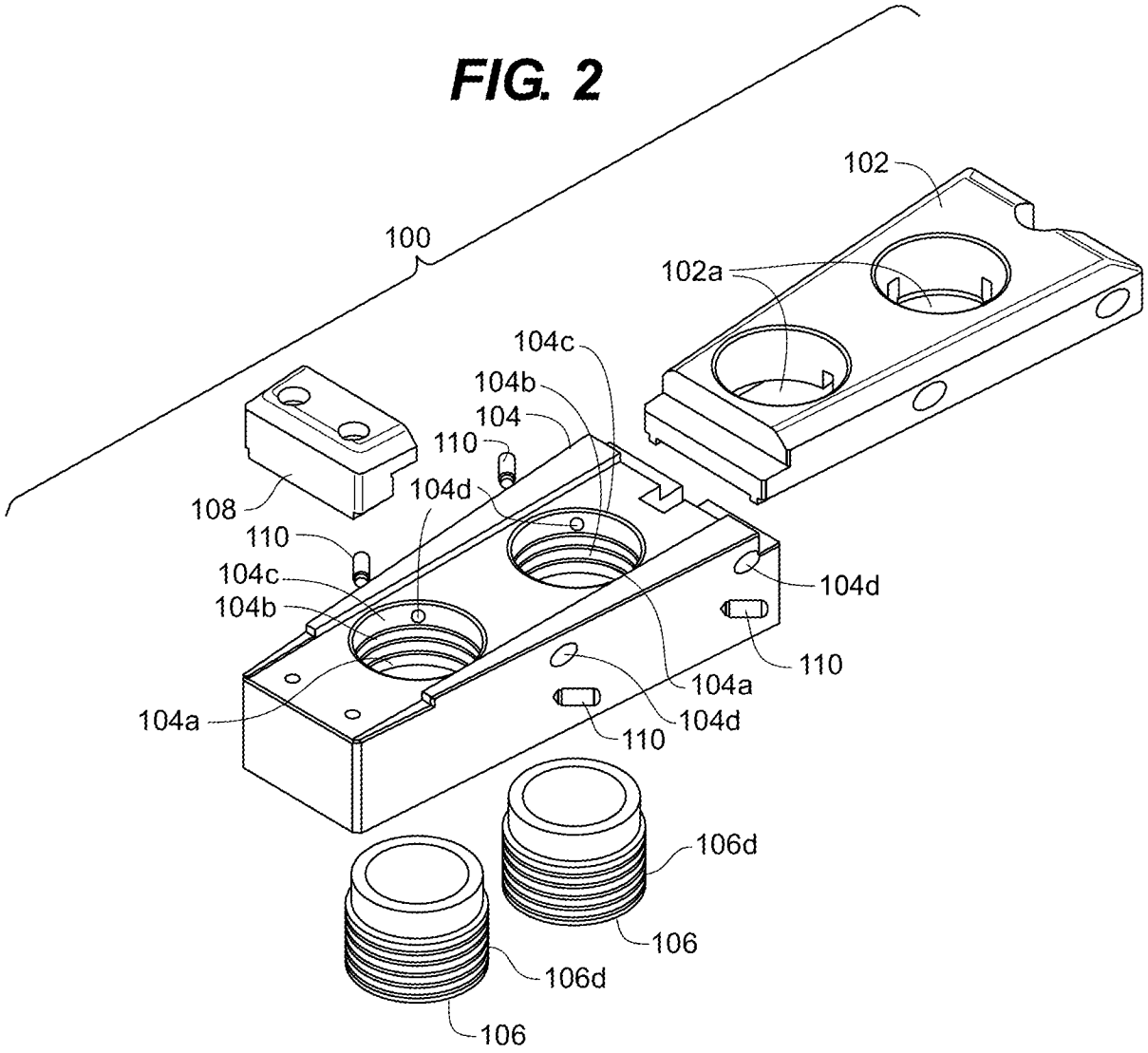
FIG. 2 is a representative exploded view of the die shoe assembly of FIG. 1.
Figure 3:
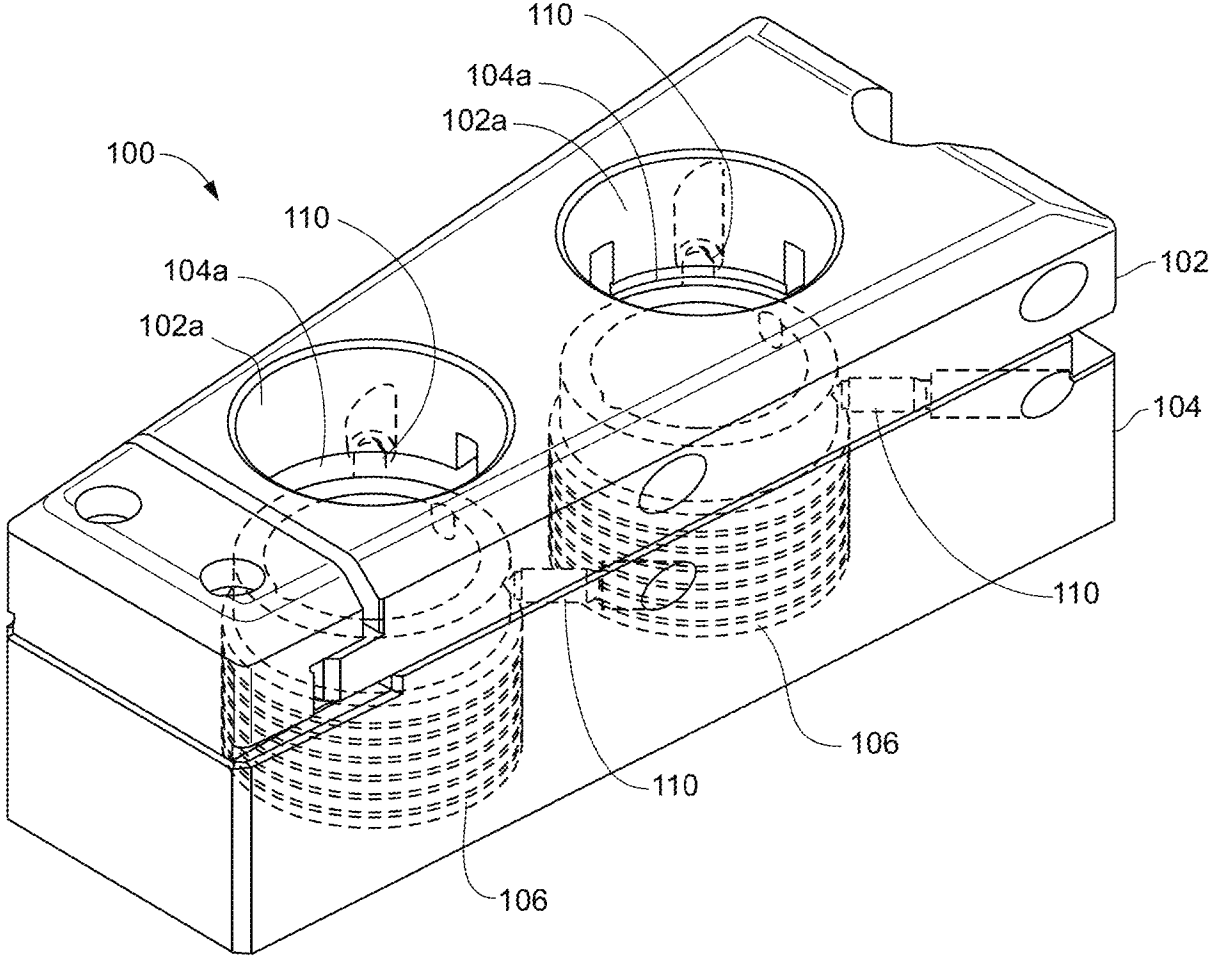
FIG. 3 is a transparent view of the die shoe assembly of FIG. 1.
Figure 6:
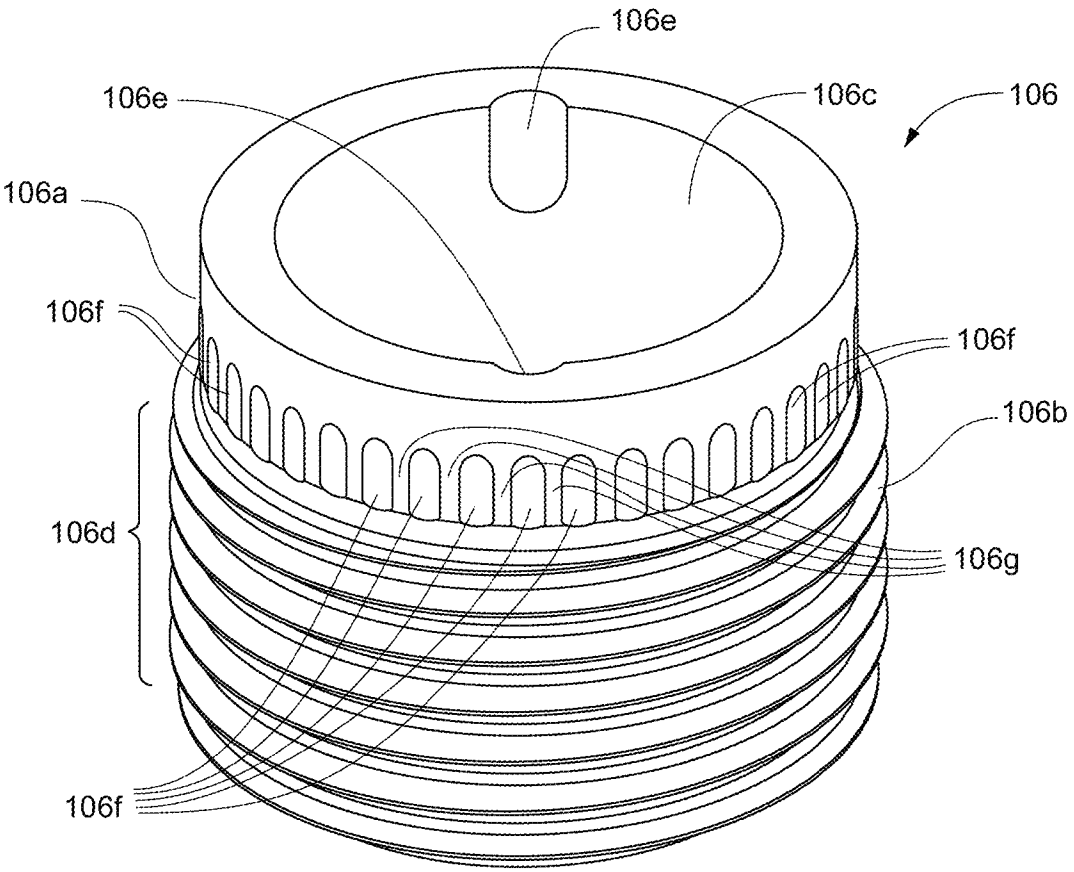
FIG. 6 is perspective side view of a die platform in accordance with certain embodiments of the invention, as also shown in the views of the die shoe assembly and the base portion of FIGS. 1-5.

FIG. 1 shows a die shoe assembly 100 in accordance with certain embodiments of the invention. As illustrated, the assembly 100 includes a guide plate 102 and a base 104. The die shoe assembly 100 is shown to be configured for a first mounting station type; however, the designs embodied herein are applicable for a variety of different mounting stations/configurations. To that end, embodiments described herein have similar design purposes yet have different configurations. Shifting back to the die shoe assembly 100 and the representative exploded view of FIG. 2, the assembly 100 is shown to include the guide plate 102, the base 104, a pair of die platforms 106, and a plate support 108. As shown, the guide plate 102 and base 104 define apertures 102*a* and recesses 104*a*, respectively, that have similar diameters in order to be aligned when the assembly 100 is constructed (as shown in FIG. 1). To that end, and with reference to the transparent view of the assembly 100 of FIG. 3, each aligned pairing of aperture 102*a* and recess 104*a* of the assembly 100 is sized to receive a die platform 106. Each die platform 106, as further detailed relative to FIG. 6, is configured to support a die (not shown) when inserted in the die shoe assembly 100. In certain embodiments, a die platform 106 is principally received within each recess 104*a* of the base 104 while a die (separately supported by the die platform 106) is principally received within the corresponding aperture 102*a* of the guide plate 102.

Figure 4:
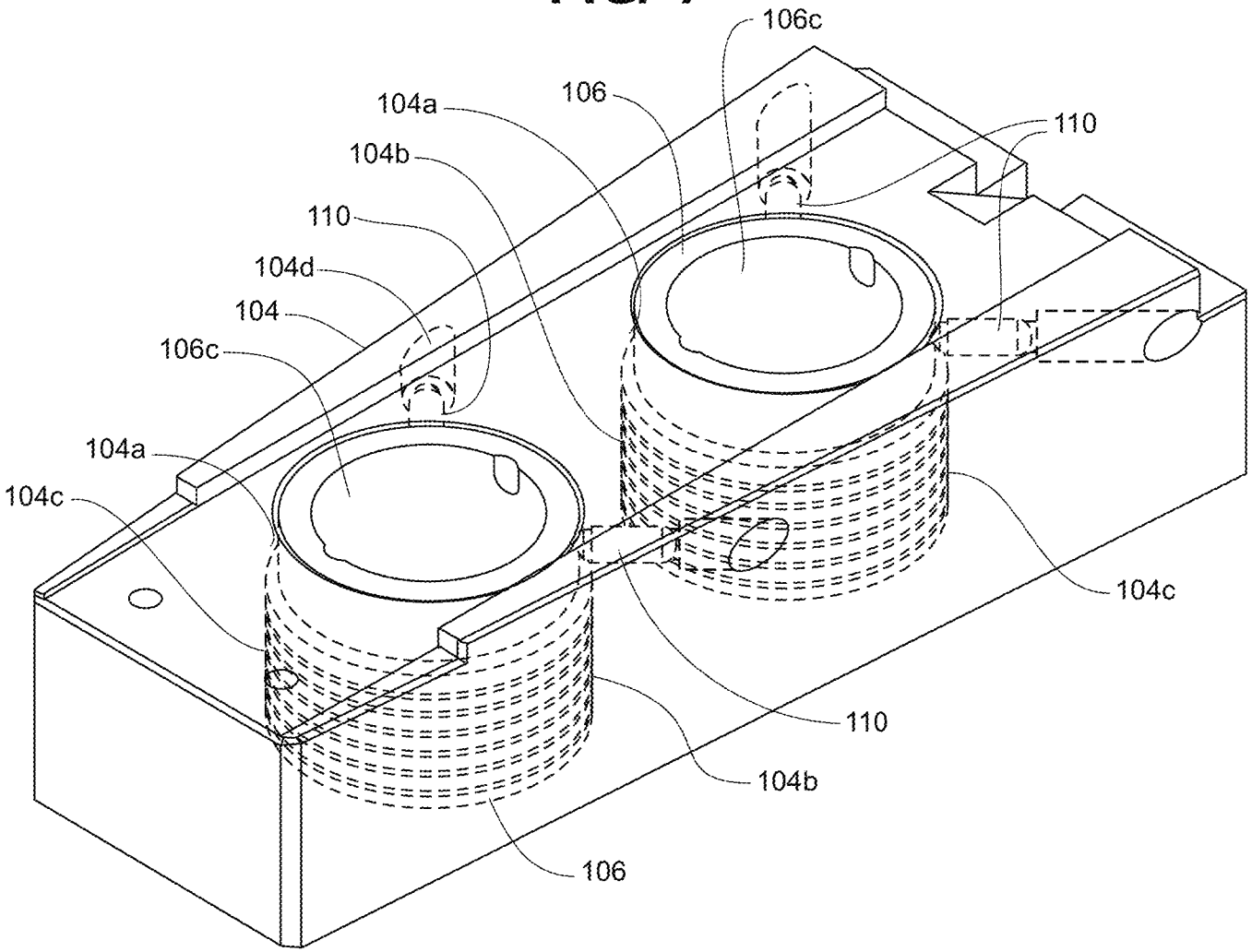
FIG. 4 is a transparent view of a base of the die shoe assembly of FIG. 1.

Continuing with the die shoe assembly 100, and turning to FIG. 4, the base 104 is transparently shown; to that end, the die platforms 106 are illustrated as being received in the recesses 104*a* of the base 104 and further extending vertically from the recesses 104*a* (so as to extend into the guide plate apertures 102*a* of the assembly 100, not shown). Shifting to FIG. 6, each die platform 106 has an upper portion 106*a* and a lower portion 106*b*, with a central cavity 106*c* defined in a top surface of the upper portion 106*a*. In certain embodiments, the lower portion 106*b* has an outer threading 106*d* configured to correspondingly mate with an inner threading 104*b* of wall 104*c* defining the recess 104*a* of the base 104 (as perhaps best shown in FIG. 2). Accordingly, the die platform 106 is configured to be vertically adjustable (or selectively raiseable or lowerable) within the die shoe assembly 100 as is warranted. Particularly, when twisted within the inner threading 104*b* defining one of the recesses 104*a*, the platform 106 correspondingly raises or lowers relative to the recess 104*a* (and guide plate aperture 102*a* there above) of the assembly 100, whereby a die positioned (in the aperture 102*a* and) on the platform 106 would have a correspondingly raised or lowered vertical position within the assembly 100.

As already explained, a die of a tool set typically needs to be sharpened over its life, and this results in the overall height of the die being reduced. The conventional way of adjusting or shifting vertical position of a die in a die shoe, via use of one or more shims being positioned beneath the die, can add delay to the overall machining process. However, with the die shoe assembly 100, this adjustment relating to a die is not provided via use of shims, but instead via the die platform 106 and corresponding vertical adjustment thereof. As described above, in certain embodiments, this adjustment can result from a single action, thereby eliminating much of the delay conventionally encountered when using shims. To that end, the single action can result in a twisting of the die platform 106. In some instances, the die platform 106 is configured to be directly engaged and subsequently adjusted via an adjustment mechanism. In certain embodiments, the adjustment mechanism is a handheld tool 112.

Figure 5:
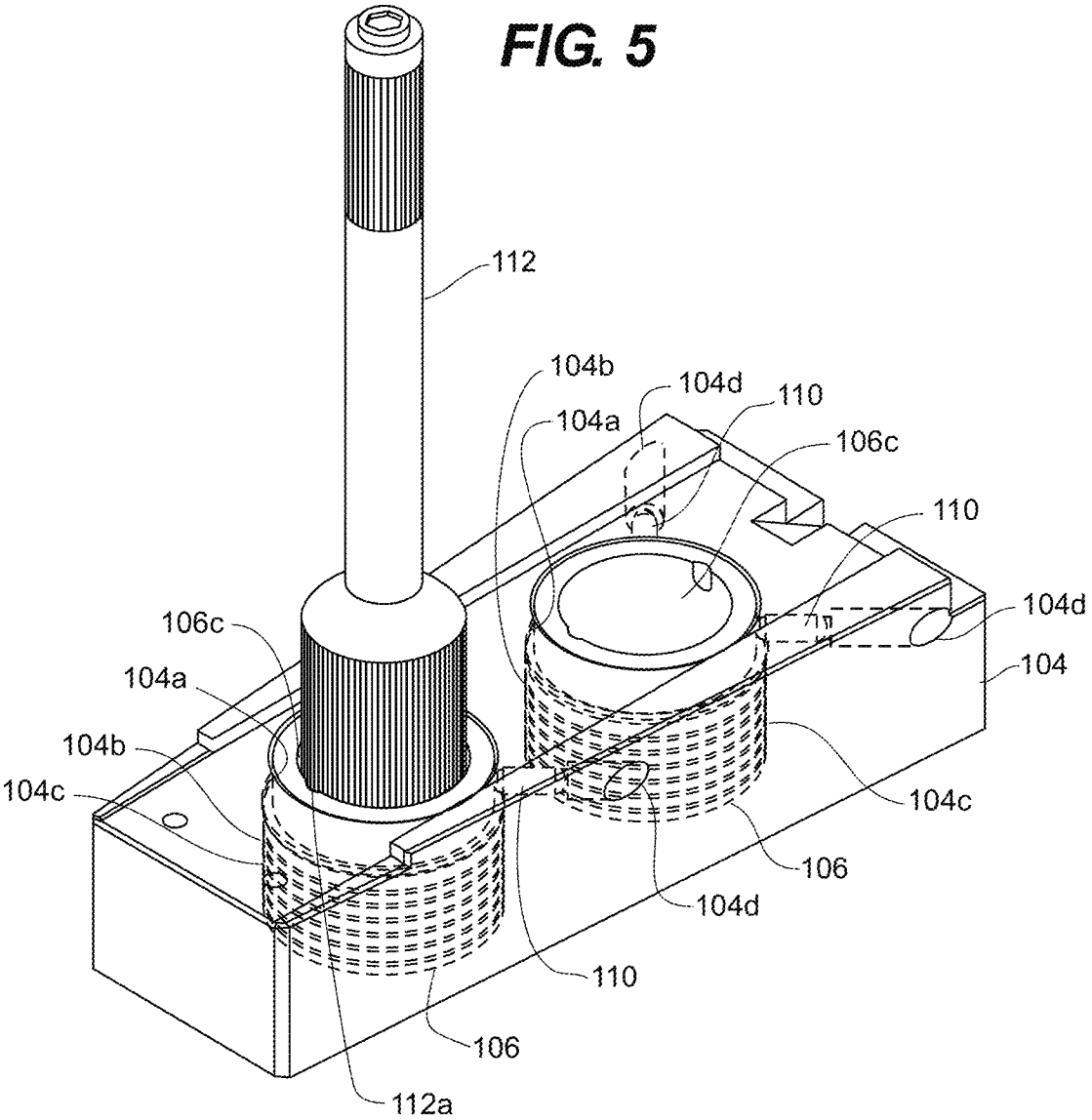
FIG. 5 is same view of the base as shown in FIG. 4, with exemplary tool being shown and engaged with base for adjusting height of a die platform in accordance with certain embodiments of the invention.

As shown in FIG. 5, the tool 112 is configured to be engaged with the die platform 106, and via twisting (or rotation) of the tool 112 once so engaged, the platform 106 would correspondingly adjust or shift in the threading 104*b* to be vertically raised or lowered within the assembly 100. Often, the adjustment to the platform 106 is to raise the platform 106 in the threading 104*b* (in order to correspondingly raise position of a die placed on the platform 106 within the assembly 100). Shifting back to FIG. 6 and the die platform 106, in certain embodiments as shown, the central cavity 106*c* is defined with one or more inner notches 106*e* (e.g., a pair of notches opposing each other, as shown) to help facilitate the platform 106 being twisted. To that end, in such embodiments, the tool 112 can have one or more corresponding outer fins 112*a* on an engaging end thereof, which are correspondingly received within the notches 106*e* when the tool 112 is engaged with (e.g., inserted in the central cavity 106*c* of) the die platform 106 to adjust the platform's vertical position in the assembly 100.

Shifting back to the die shoe assembly 100 (of FIGS. 1-5), a pair of apertures 102*a* are shown in the guide plate 102 for holding a corresponding pair of dies. To that end, the pair of apertures 102*a* as well as the corresponding pair of recesses 104*a* aligned beneath generally have the same diameter so as to receive same size of die platform 106 therein. Accordingly, the same adjustment mechanism (handheld tool 112) can be used to adjust (raise or lower) the die platform 106 within each of the recesses 104*a*. Although, as will be demonstrated via other assemblies embodied herein (such as with die shoe assembly 150 of FIG. 7), the apertures of the guide plate 102 can differ in diameter (along with the aligned recesses of the base) in order to be configured to hold different-sized die platforms (and corresponding different-sized dies). Further, while the die shoe assembly 100 and other assemblies embodied herein are configured to retain a quantity of two dies, the invention should not be so limited. Instead, aspects of the assemblies embodied herein are applicable to die shoe assemblies configured to retain a single or any other die quantity, within reason.

To this point, focus has primarily been qualitative in nature, in terms of facilitating the adjustment (of vertical position of dies used within the die shoe assembly 100), whereby one embodiment is described as threadedly linking the die platform 106 within the assembly 100 and direct twisting of the platform 106 to provide the adjustment. Of course, a further consideration is quantitative in nature, as to the extent of adjustment. Shifting back to FIGS. 2, 4, and 5, in certain embodiments, the die shoe assembly 100 can include a plurality of plungers 110. The plungers 110 are received in corresponding through-holes 104*d* opening on sides of the base 104 and exiting into the recesses 104*a* defined therein. As shown, the plungers 110 are positioned in the through-holes 104*d* so as to jut outward into the recesses 104*a* and correspondingly contact the die platforms 106 therein. Particularly, in certain embodiments as shown in FIG. 6, the upper portion 106*a* of the die platform 106 is defined with a plurality of indentations 106*f* about its outer periphery, and the plungers 110 are configured to move between the indentations 106*f* as the platform 106 is twisted.

It should be appreciated that extension of the plungers 110 into the indentations 106*f* enables the die platform 106 prevents incidental twisting of the die support 106, e.g., resulting from vibrations or other unanticipated external stimuli. However, functioning of the plungers 110 relative to the indentations 106*f* can also serve to signal the extent of adjustment made. For example, twisting of the tool 112 (with reference to FIG. 5, to correspondingly twist the die platform 106 in its recess 104*a*) causes the plungers 110 to correspondingly shift between the indentations 106*f* of the platform 106. Shifting attention back to FIG. 6, contact of the plungers 110 with each raised portion 106*g* between neighboring indentations 106*f* (as the platform 106 is twisted), in certain embodiments, can correspondingly create an auditory click. In alternate embodiments, or in combination, contact of the plungers 110 with each raised portion 106*g* between neighboring indentations 106*f* (as the platform 106 is twisted) can correspondingly create a force on the tool 112, opposite the twisting force, which is felt by the user. To that end, every click heard and/or force felt and overcome signals an iteration of adjustment in vertical position (raising or lowering) of the die platform 106, which also results in corresponding adjustment in vertical position of die (positioned on the platform 106 and) used with the assembly 100.

Thus, compared to the uncertainty often involved (in zeroing in on a new machining height for the die) via the conventional approach of using shims, the die shoe assembly 100 is configured to be adjusted without shims, while enabling the adjustment to be effectively and accurately provided. For example, in certain embodiments and largely based on pitch of the threading 106*d*, each iteration can represent a 0.01 mm (0.004") adjustment in vertical position. To that end, a clockwise twisting of the tool 112 would correspond with a raising in position of the die platform 106 within (the recess 104*a* of) the die shoe assembly 100, while a counterclockwise twisting of the tool 112 would correspond with a lowering in position of the platform 106 within (the recess 104*a* of) the assembly 100.

As will be further exemplified herein, there can be variations relative to the designs of the die platform and/or the mechanism (described to this point as a tool), while still being able to bring about similar manner of adjustment to the die platform. For example, regarding the mechanism, an alternate design may involve the mechanism being integrated within the die shoe assembly (e.g., like the manner by which the die platform 106 is integrated within the assembly of FIG. 1). As would be appreciated, such a design would provide fewer loose elements (in comparison to the assembly 100 of FIG. 1; i.e., no loose tool 112) but would also likely involve a more complex design to internally link the integrated mechanism to the integrated die platform. Taken solely or in combination with an alternate design of the mechanism, an alternate design of die platform could be provided. For example, such alternate design could involve the bottom portion of the die platform being configured to link (directly or indirectly) to the mechanism (as opposed to the top portion 106*a* being configured for such linkage, as is embodied with the die platform 106 for assembly 100 of FIG. 1).

Further, and in reference back to FIG. 6, the designed pitch of the threading 106*d* of the platform 106 can be particularly significant. As already noted, the thread pitch angle can impact the relation between mechanism adjustment and die platform adjustment. Additionally, it has also been found that shallower thread angles for such threading 106*d*, and the frictional forces that result therefrom, can enhance control against incidental rotation of the die platform 106, in some cases as a compliment to the control attained using the plungers 110 and indentations 106*f* and in other cases as an alternative. Relative to frictional forces being suitably chosen (for reliable engagement against unintended self-adjustment of the die platform 106), diameter size and pitch thread each play a factor, along with the friction coefficient for the thread material. To that end, in general, as the diameter is reduced (or increased), the thread pitch must also correspondingly reduce (or increase) to keep reliable engagement (or suitable factor of safety). For example, in certain embodiments generally relating to steel on steel, the ratio of diameter to thread pitch is provided in the range of between 13 and 14 for reliable engagement.

Figure 7:
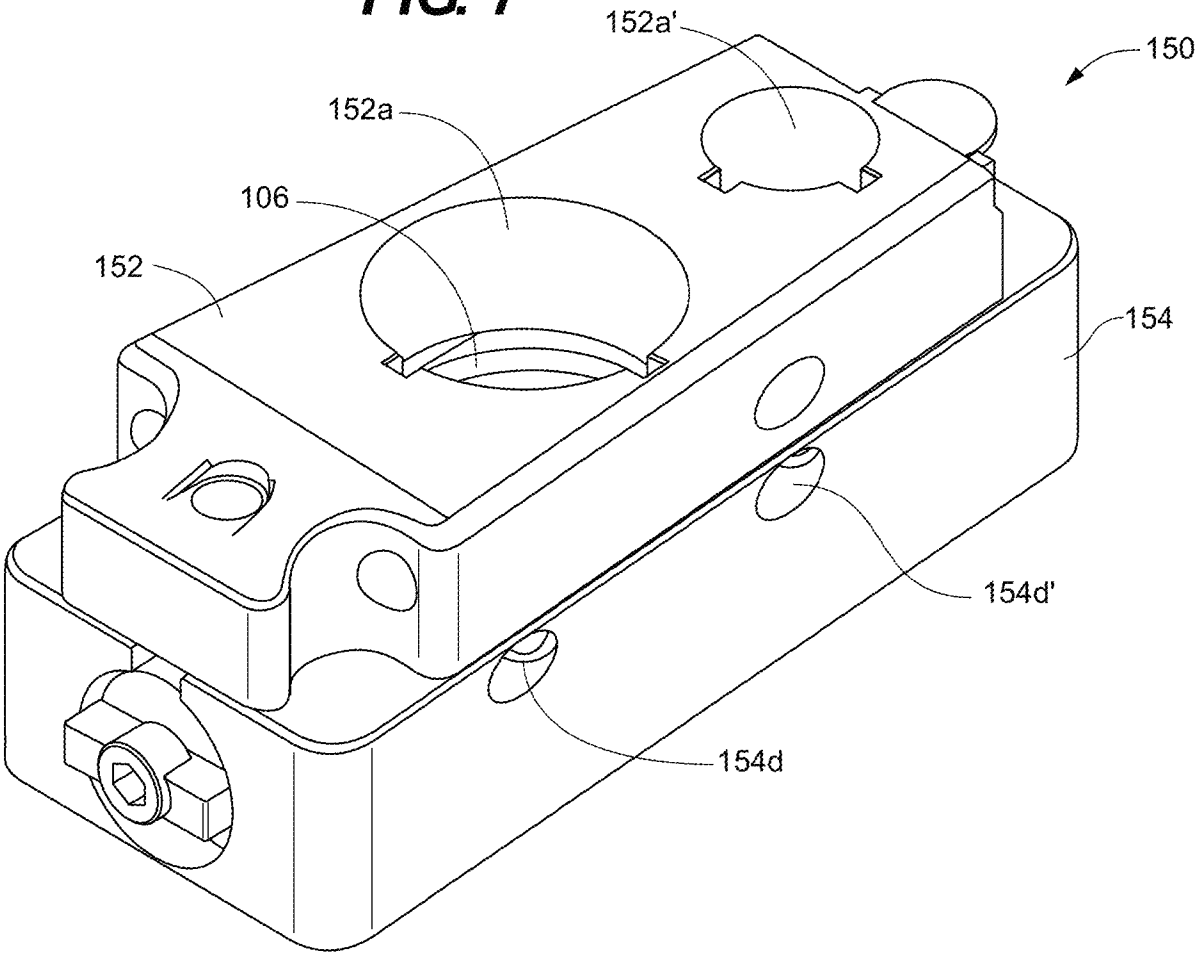
FIG. 7 is a perspective side view of another die shoe assembly of similar design as shown in FIG. 1 and configured for a second station type in accordance with certain embodiments of the invention.
Figure 8:
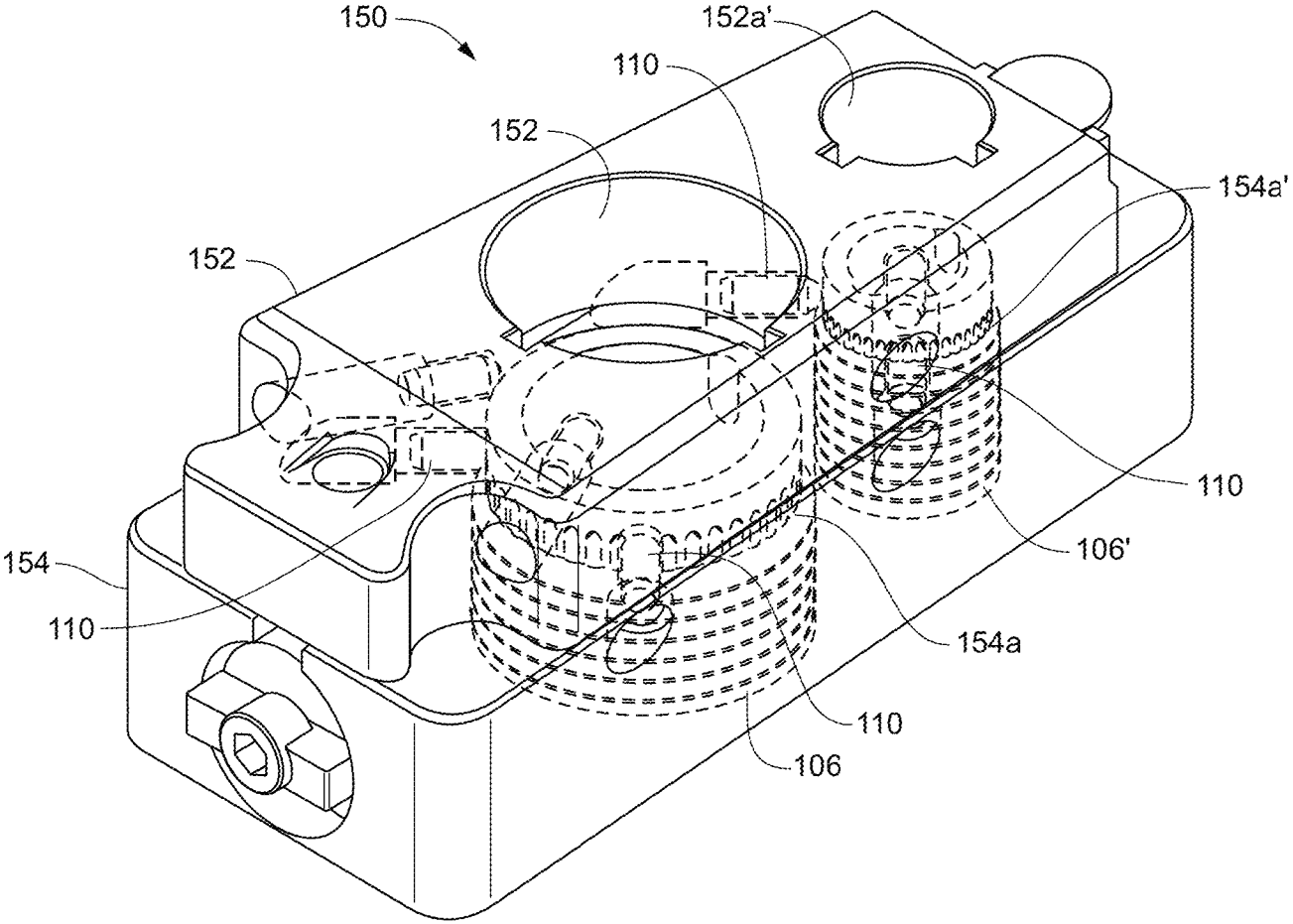
FIG. 8 is a transparent view of the die shoe assembly of FIG. 7.

As already alluded to, FIG. 7 shows another die shoe assembly 150 in accordance with certain embodiments of the invention. Particularly, the assembly 150 is of similar design to the assembly 100 of FIG. 1 yet configured for a second mounting station type. To that end, the assembly 150 includes a guide plate 152 defined with a pair of apertures 152*a* and 152*a*' and a base 154 defined with a pair of recesses 154*a* and 154*a*', whereby the corresponding apertures and recesses align when the assembly 150 is constructed. With reference to the transparent view of the assembly 150 of FIG. 8, each correspondingly aligned aperture and recess (152*a* and 154*a*, and 152*a*' and 154*a*') of the assembly 150 are sized to receive correspondingly-sized die platforms 106 and 106'. Accordingly, the platforms 106 and 106' are configured to support different, yet correspondingly-sized dies (not shown) when used with the die shoe assembly 150.

Figure 9:
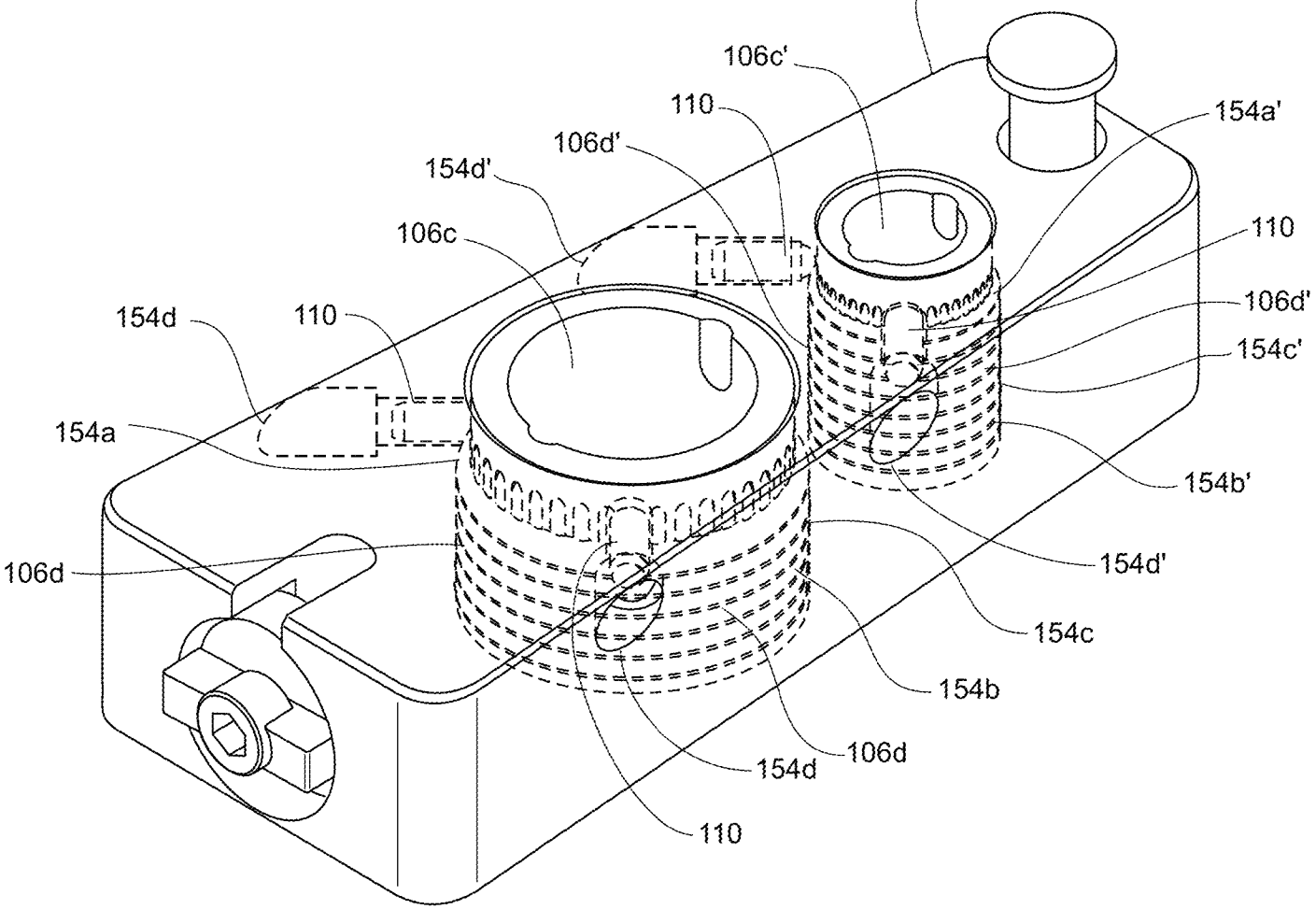
FIG. 9 is a transparent view of a base of the die shoe assembly of FIG. 7.

Continuing with the die shoe assembly 150, and turning to FIG. 9, the base 154 is transparently shown; to that end, the die platforms 106, 106' are illustrated as received in the recesses 154*a*, 154*a*' of the base 154 and vertically extend therefrom (so as to further vertically extend into the apertures 152*a*, 152*a*' of the guide plate 152 of the assembly 150). Like that already described relative to the die shoe assembly 100 of FIG. 1, the die platforms 106, 106' are configured to be vertically adjustable (or selectively raiseable or lowerable) within the die shoe assembly 150 as warranted. Particularly, when twisted within inner threading 154*b*, 154*b*' defining the recesses 154*a*, 154*a*', the corresponding platforms 106, 106' are vertically adjusted (raised or lowered), whereby dies positioned (in the corresponding guide plate apertures 152*a*, 152*a*' and) on the platforms 106, 106' are also correspondingly adjusted vertically in the die shoe assembly 150.

Thus, like the die shoe assembly 100 of FIG. 1, the vertical positions of dies used in the assembly 150 can be adjusted without use of shims, particularly via corresponding adjustment of the die platforms 106, 106'. With reference back to the embodied die platform 106 of FIG. 6, the die platform 106' of the die shoe assembly 150 has similar features (despite its smaller size), particularly having an upper portion 106*a*', a lower portion 106*b*', a central cavity 106*c*', outer threading 106*d*', and a plurality of indentations 106*f* about its upper portion's outer periphery. Accordingly, adjustment of each of the die platforms 106, 106' is a similar process, and can result from a single action involving simple twisting of the platforms 106, 106'. To that end, in some instances, the die platforms 106, 106' can be directly engaged and subsequently actuated, the embodiments of which FIGS. 10 and 11 respectively depict.

Figure 10:
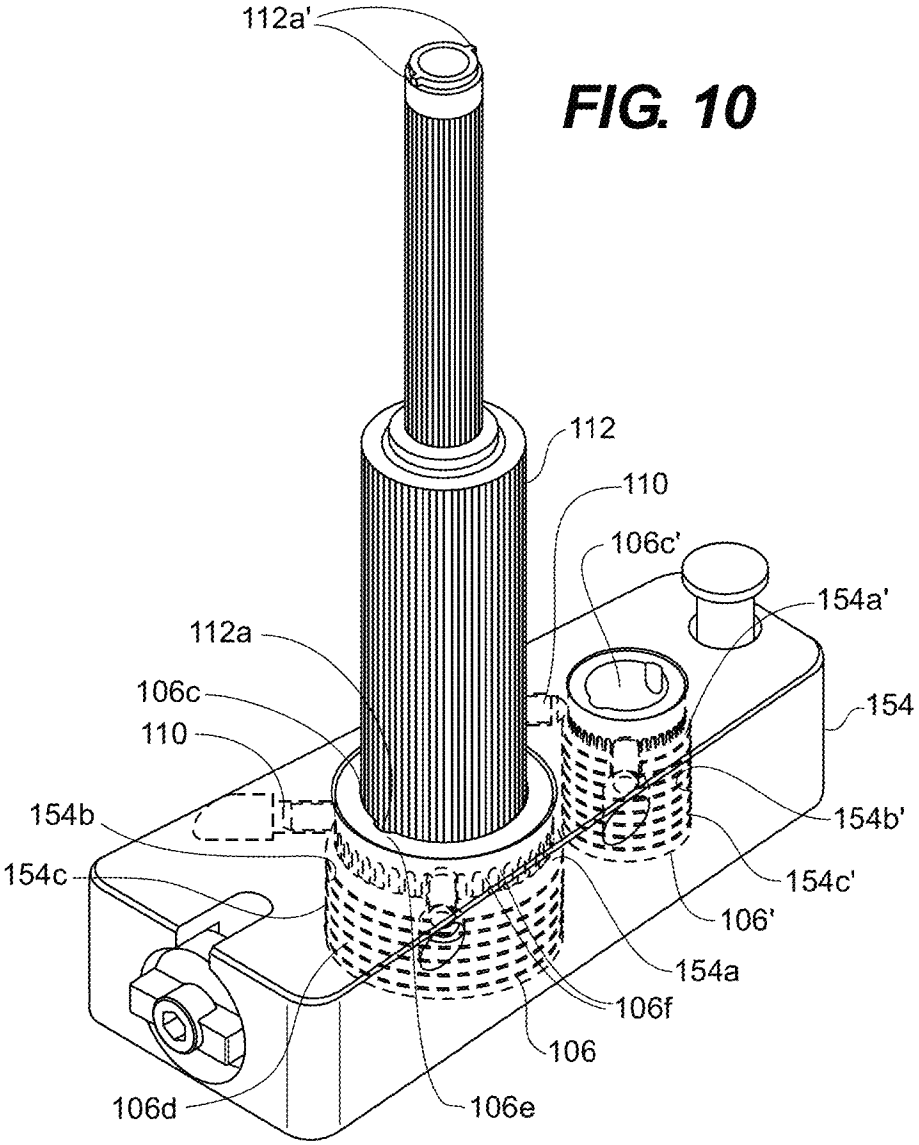
FIG. 10 is same view of the base as shown in FIG. 9, with exemplary tool being further shown and engaged for adjusting height of a first of the die platforms in accordance with certain embodiments of the invention.
Figure 11:
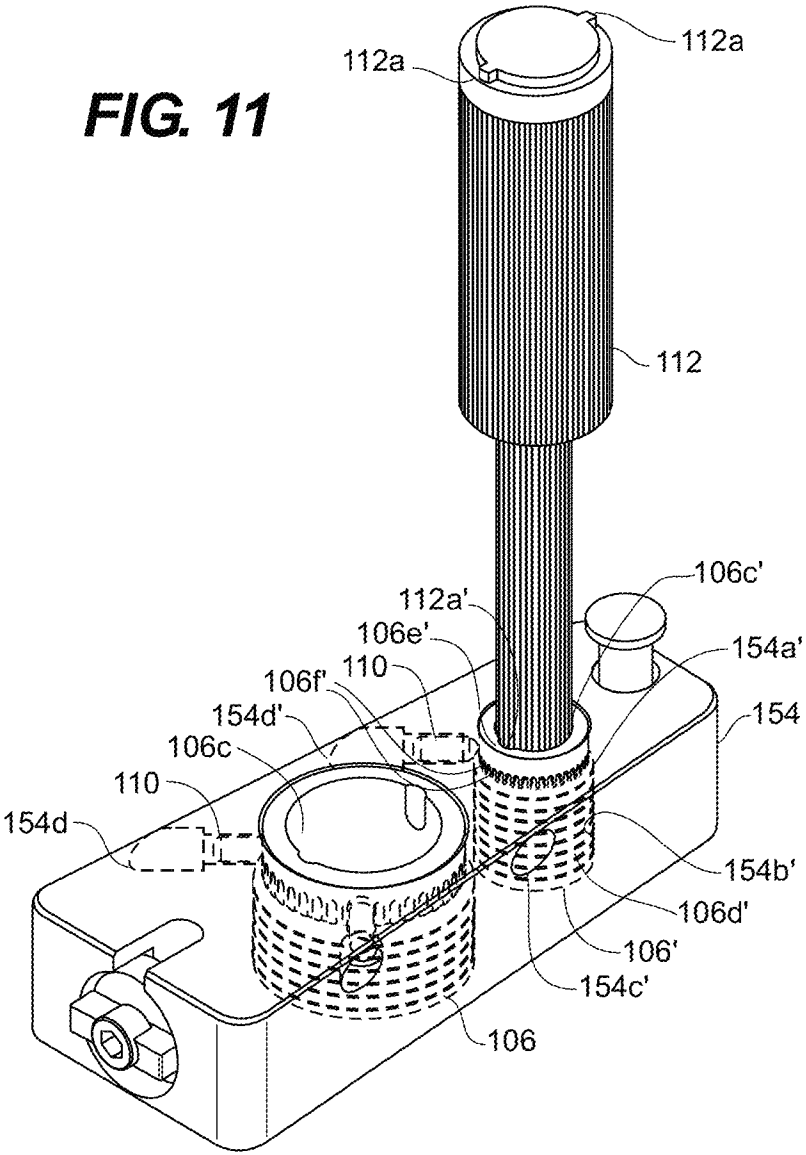
FIG. 11 is same view of the base as shown in FIG. 9, with exemplary tool being further shown and engaged for adjusting height of a second of the die platforms in accordance with certain embodiments of the invention.

Particularly, as shown in FIG. 10, via use of the handheld tool 112, configured to engage the die platform 106 and twisting (rotating) of that tool 112 once so engaged, the platform 106 would correspondingly adjust or shift in the threading 154*b* of the recess 154*a* so as to vertically raise or lower within the assembly 150. Likewise, as illustrated in FIG. 11, the vertical position of the further platform 106' can be adjusted via similar use of the tool 112 yet with its opposing end (having smaller outer diameter) relative to (the correspondingly smaller inner diameter of) the platform 106'. In using the tool 112, and similar to that described with the die shoe assembly 100 of FIG. 1, the central cavities 106*c*, 106*c*' of the die platforms 106, 106' can each have one or more notches 106*e*, 106*e*' defined therein to help facilitate the platforms 106, 106' being twisted. In certain embodiments as shown, the tool 112 can have corresponding fins 112*a*, 112*a*' (e.g., on each opposing end of the tool) which are received within the notches 106*e*, 106*e*' when the tool 112 is engaged with (inserted in the central cavities 106*c*, 106*c*' of) the die platforms 106, 106' to adjust their vertical positions within the die shoe assembly 150.

Shifting back to FIGS. 9-11 (and like that already described for the assembly 100), in certain embodiments, the die shoe assembly 150 includes a plurality of plungers 110. To that end, the plungers 110 are respectively received in corresponding through-holes 154*d*, 154*d*' opening on sides of the die shoe base 154 and exiting into the recesses 154*a*, 154*a*' therein. As shown, the plungers 110 are positioned in the through-holes 154*d*, 154*d*' so as jut outward into the recesses 154*a*, 154*a*' and correspondingly contact the die platforms 106, 106' therein. Like that described for the assembly 100 of FIG. 1, extension of the plungers 110 into the indentations 106*f*, 106*f* enables the die platforms 106, 106' to be retained at their adjusted vertical positions, while also preventing unintentional adjustment (twisting) of the die platforms 106, 106'.

Twisting of the tool 112 (with reference to FIGS. 10 and 11, to correspondingly twist the die platform 106 in its recess 104*a*, and the die platform 106' in its recess 104*a*') causes the plungers 110 to correspondingly move between the indentations 106*f*, 106*f*' of the platforms 106, 106'. Relative to the die platform 106' (and similar to the process already described for the die platform 106 for assembly 100), contact of the plungers 110 with each raised portion between neighboring indentations 106*f*' (as the platform 106' is twisted), in certain embodiments, can correspondingly create an auditory click. In alternate embodiments, or in combination, contact of the plungers 110 with each raised portion between neighboring indentations 106*f*(as the platform 106' is twisted), can correspondingly create a force on the tool 112, opposite the twisting force, which is felt by the user. Thus, every click heard and/or force felt and overcome signals an iteration of adjustment in vertical position (raising or lowering) of the die platform 106', which also results in corresponding adjustment in vertical position of die (positioned on the platform 106' and) used with the assembly 150. Again, in certain embodiments and based on pitch of the threading 106*d*', each iteration can represent 0.01 mm (0.004") adjustment in vertical position of the die platforms 106'. To that end, relative to the die platform 106', a clockwise twisting of the tool 112 would correspond with a raising in position of the platform 106' within the die shoe assembly 150, while a counterclockwise twisting of the tool 112 would correspond with a lowering in position of the platform 106' within the assembly 150.

As noted above, the assemblies embodied herein are provided in differing configurations, yet are designed to facilitate similar adjustments relative to the die shoes. To that end, attention is now turned to FIG. 12, which illustrates a representative exploded view of another die shoe assembly 200 in accordance with certain embodiments of the invention. As shown, the assembly 200 is configured for first mounting station type, and includes many similar elements already described herein, e.g., relative to the die shoe assembly 100 of FIG. 1. Particularly, the assembly 200 includes a guide plate 202 defined with a pair of apertures 202*a*, a base 204 defined with a pair of recesses 204*a*, a pair of die platforms 206, and a plate support 208. To that end, the die platforms 206 provide support for dies (not shown) used with the assembly 200, and are configured to be selectively adjustable (to be raised or lowered) within the assembly 200 to correspondingly adjust vertical positioning of the dies, as already described for the assemblies 100 and 150. However, what differs are the mechanisms by which the platforms 206 are adjusted, and by which the desired extent of adjustment can be effectively and accurately provided.

Continuing with the above, and like the platforms 106, 106' described for assemblies 100 and/or 150, the die platforms 206 are adjustable via twisting of the same within inner threading 204*b* of the recesses 204*a* defined in the base 204. In certain embodiments, this adjustment can result from a single action, thereby eliminating much of the delay conventionally encountered when using shims. To that end, the single action can result in a twisting of a corresponding die platform 206. In some instances, the die platforms 206 are configured to be operably connected to an adjustment mechanism integrated within the assembly 200 (as opposed to a mechanism situated independent of the die shoe, such as tool 112 described relative to assemblies 100 and 150). Regarding die shoe assembly 200, in certain embodiments, the adjustment mechanism is a feedthrough fastener 210. To that end, each feedthrough fastener 210, in certain embodiments, is operatively linked to one of the die platforms 206 via a gear assembly 212. For example, and with reference to FIGS. 12 and 14, the gear assembly 212 has interlinked first (upper) and second (lower) gears 212*a*, 212*b*, wherein one of the gears (e.g., the upper gear 212*a*) can be operatively connected to one of the fasteners 210, while the other gear (accordingly, the lower gear 212*b*) can be operatively connected to the corresponding die platform 206.

Figure 13:
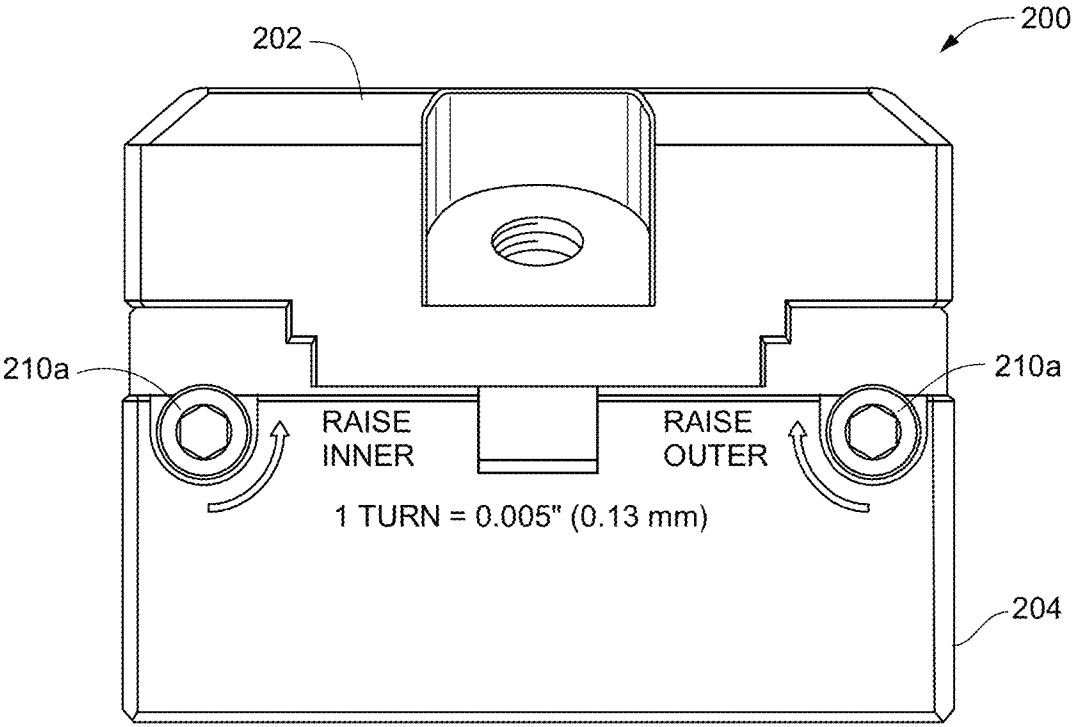
FIG. 13 is an elevation view of rear side of the die shoe assembly of FIG. 12 when constructed.

Turning to FIG. 13, an end of the assembly 200 is shown, from which heads 210*a* of the feedthrough fasteners 210 protrude. To that end, it is noted that as the fasteners (e.g., through bolts) 210 are twisted (via rotation of the heads 210*a* with a tool, e.g., Allen wrench), the corresponding die platforms 206 (to which the fasteners 210 are operatively connected) also twist. Particularly, each die platform 206 is twisted (rotated) within a corresponding one of the recesses 204*a* defined in the base 204, whereby vertical positioning of the platform 206 is adjusted. To that end, and as exemplarily imprinted on the assembly end, every complete (or full) turn of one of the fastener heads 210*a* corresponds with an iteration of adjustment in vertical position (raising or lowering) of the corresponding die platform 206, which also results in corresponding adjustment in vertical position of die (positioned on the platform 206 and) used with the assembly 200. In certain embodiments as shown, each iteration can represent 0.13 mm (0.005") shift in vertical position of the corresponding die platform operably connected thereto.

It should be appreciated that the relationship between rotation of the fasteners 210 and corresponding adjustment in height of the die platforms 206 within the assembly 200 can be varied based on change in thread pitch of the outer threading 206*d* of the platforms 206. With further reference to FIG. 13, relationship between rotation direction of the fastener heads 210*a* and adjustment to the corresponding die platform 206 can depend on placement of the fastener 210 relative to its corresponding platform 206. For instance, in one embodiment as shown, a counterclockwise twisting of the (head 210*a* of the) fastener 210 linked to the farther (or inner) of the two die platforms 206 of the assembly 200 (and perhaps best shown relative to FIG. 14), would correspond with a raising of that platform 206, while a clockwise twisting of that same fastener 210 would correspond with lowering of that platform 206 within the assembly 200. Then, relative to the other fastener 210 (protruding from other side of assembly end) linked to the closer (or outer) of the platforms 206 (and perhaps best shown relative to FIG. 15), a clockwise twisting of the fastener 210 (via its head 210*a*) would correspond with a raising of that platform 206, while a counterclockwise twisting of that same fastener 210 would correspond with a lowering of that platform 206 within the assembly 200.

Figure 14:
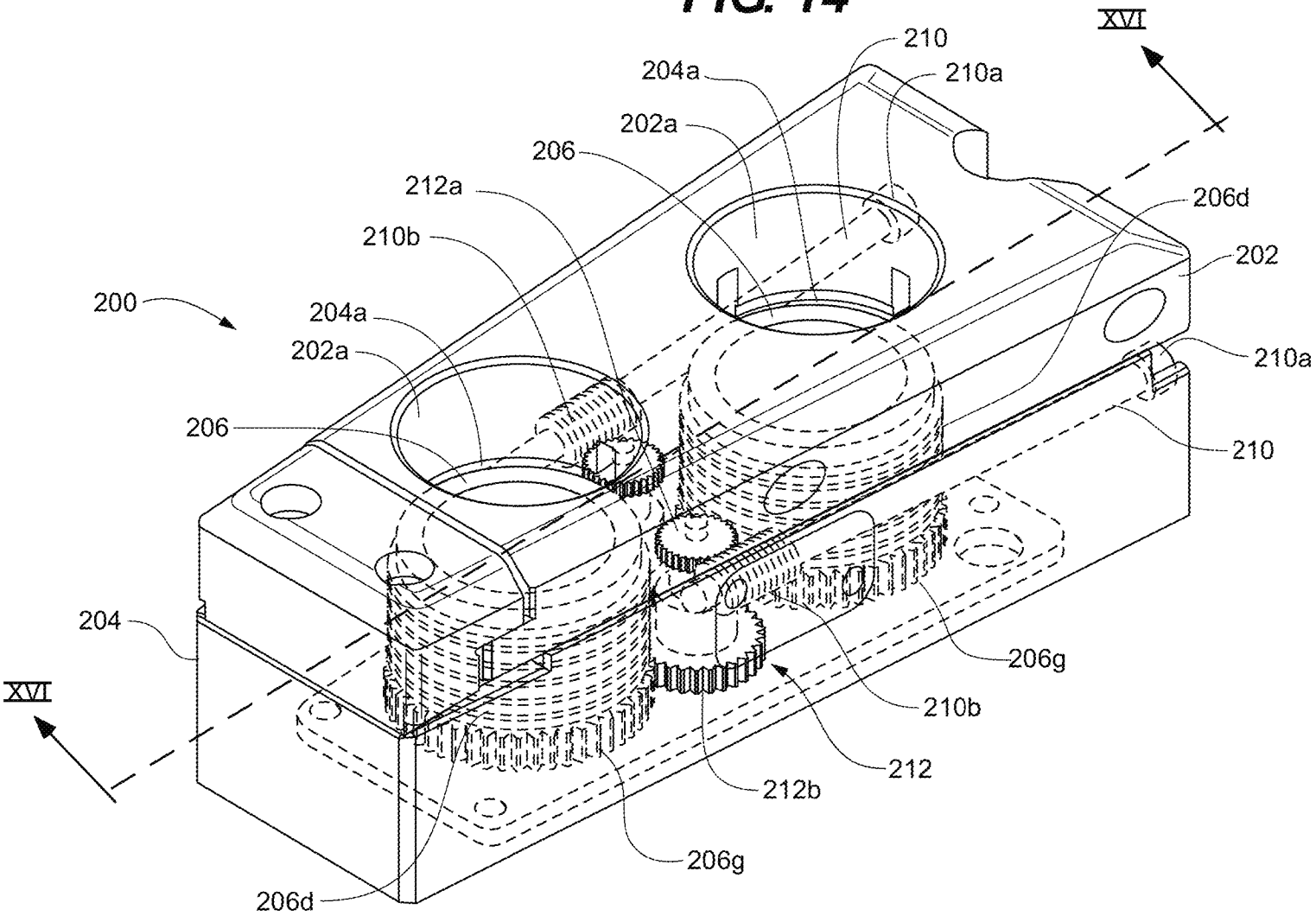
FIG. 14 is a transparent view of the die shoe assembly of FIG. 12 when constructed, showing an exemplary configuration of gear design in accordance with certain embodiments of the invention.
Figure 15:
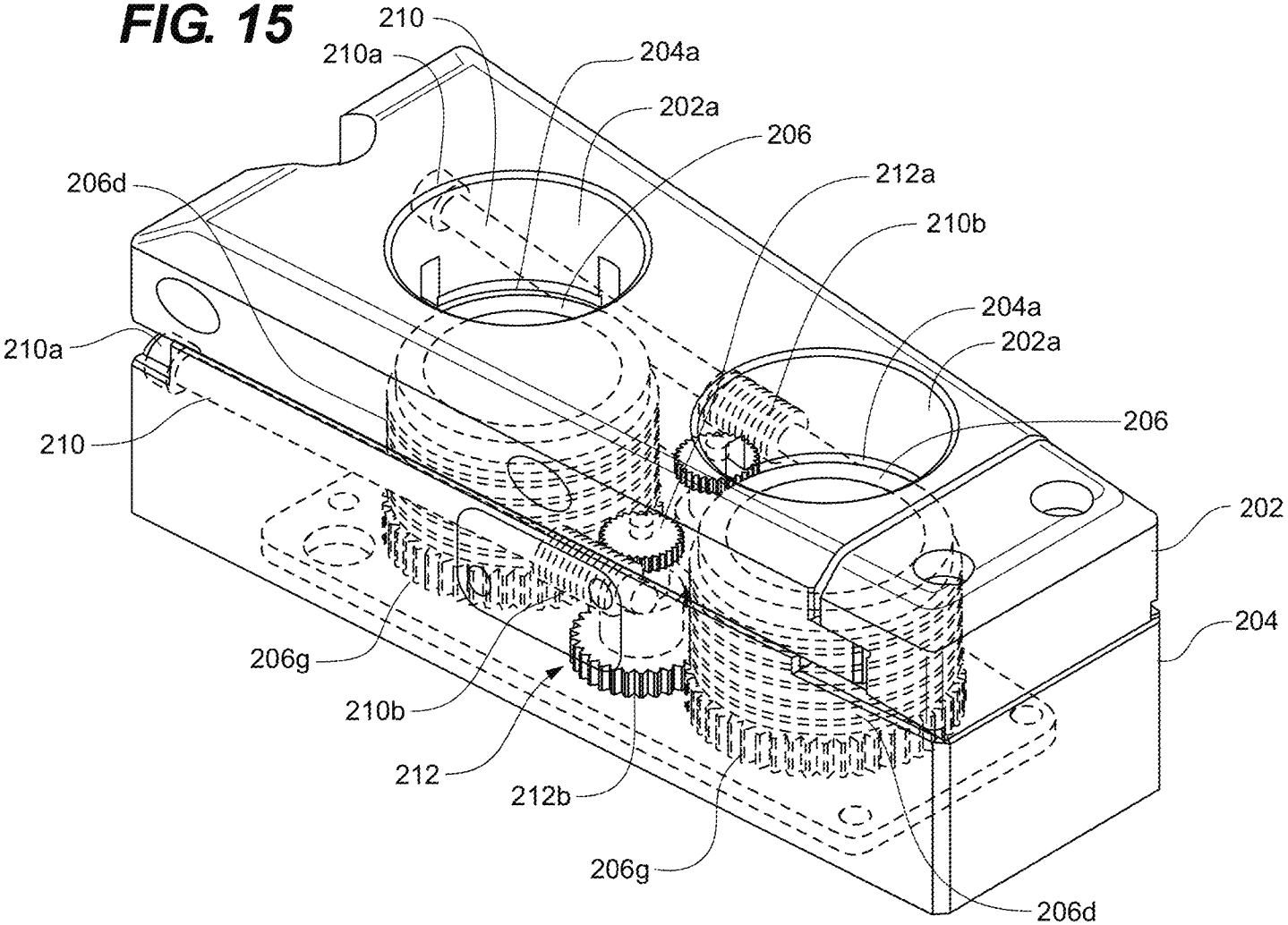
FIG. 15 is a transparent view of the die shoe assembly of FIG. 12 when constructed, shown from side opposite of that shown in FIG. 14.
Figure 16:
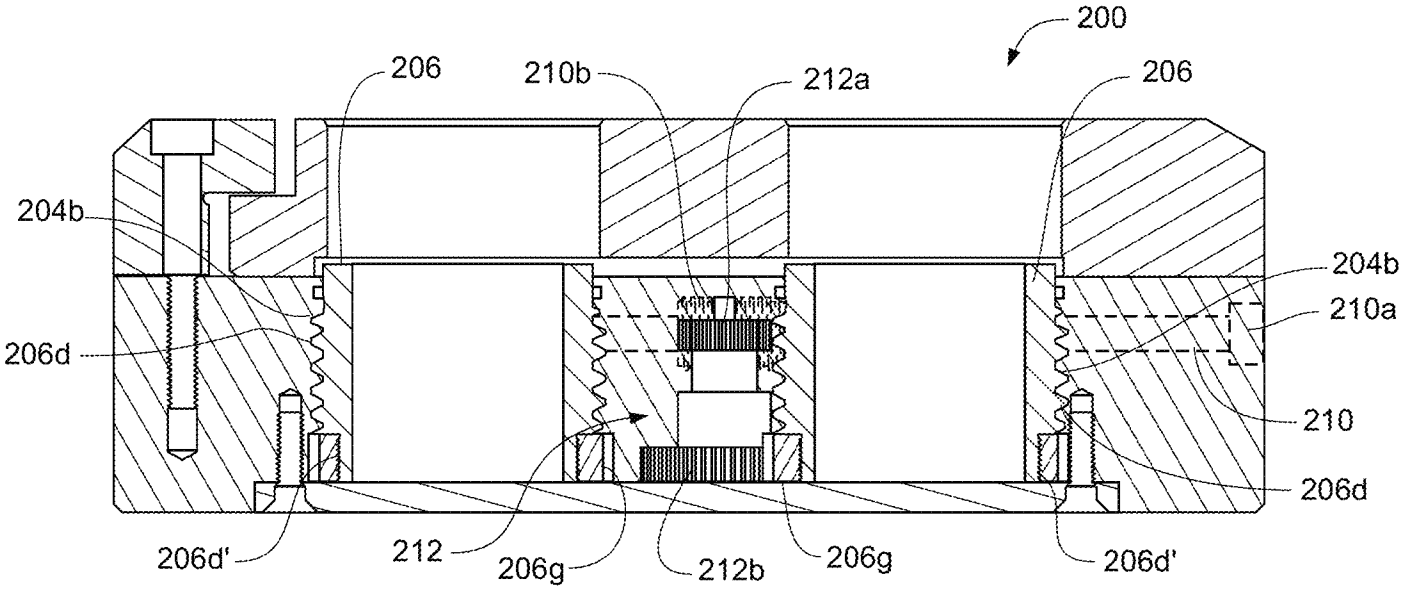
FIG. 16 is a cross-sectional view of the die shoe assembly of FIG. 14, taken along lines XVI-XVI and showing a first exemplary manner of connection to die platforms in accordance with certain embodiments of the invention.

Turning to the transparent views of the die shoe assembly 200 of FIGS. 14 and 15, each pair of correspondingly aligned aperture and recess 202*a* and 204*a* of the assembly 200 is sized to receive a correspondingly sized die platform 206 (to correspondingly support a die when used with the die shoe assembly 200). As described above, each feedthrough fastener 210, in certain embodiments, is operatively linked to one of the die platforms 206 via interlinked first and second gears 212*a*, 212*b*. In further embodiments (and with reference also to FIG. 12), each fastener 210 is operably linked to one of the gears (e.g., first, upper gear 212*a*) via threaded insert 210*b*, while the other gear (e.g., second, lower gear 212*b*) is operably linked to the die platform 206 via ring gear 206*g* positioned (at a base) on the die platform 206. Accordingly, as one of the fasteners 210 is rotated (via its head 210*a* being twisted, see FIG. 13), the insert 210*b* thereon is correspondingly rotated. Yet, in certain embodiments, for each of the fasteners 210/die platforms 206 pairings (as shown in FIGS. 14 and 15), the insert 210*b* is spatially held (e.g., within a pocket 204*d* defined) by the base 204. As such, rotation of the insert 210*b* results in rotation of the first, upper gear 212*a*, and due to the linkage between first and second gears 212*a*, 212*b* via the gear assembly 212, rotation of the first gear 212*a* results in corresponding rotation of the second gear 212*b*. In turn (and with reference to FIG. 16), rotation of second gear 212*b* results in ring gear 206*g* being correspondingly rotated, and such rotation, via interlinking between the ring gear 206*g* and base threading 206*d*' of the platform 206, results in the vertical position of the platform 206 to be adjusted in the recess threading 204*b* of the base 204.

Figure 12:
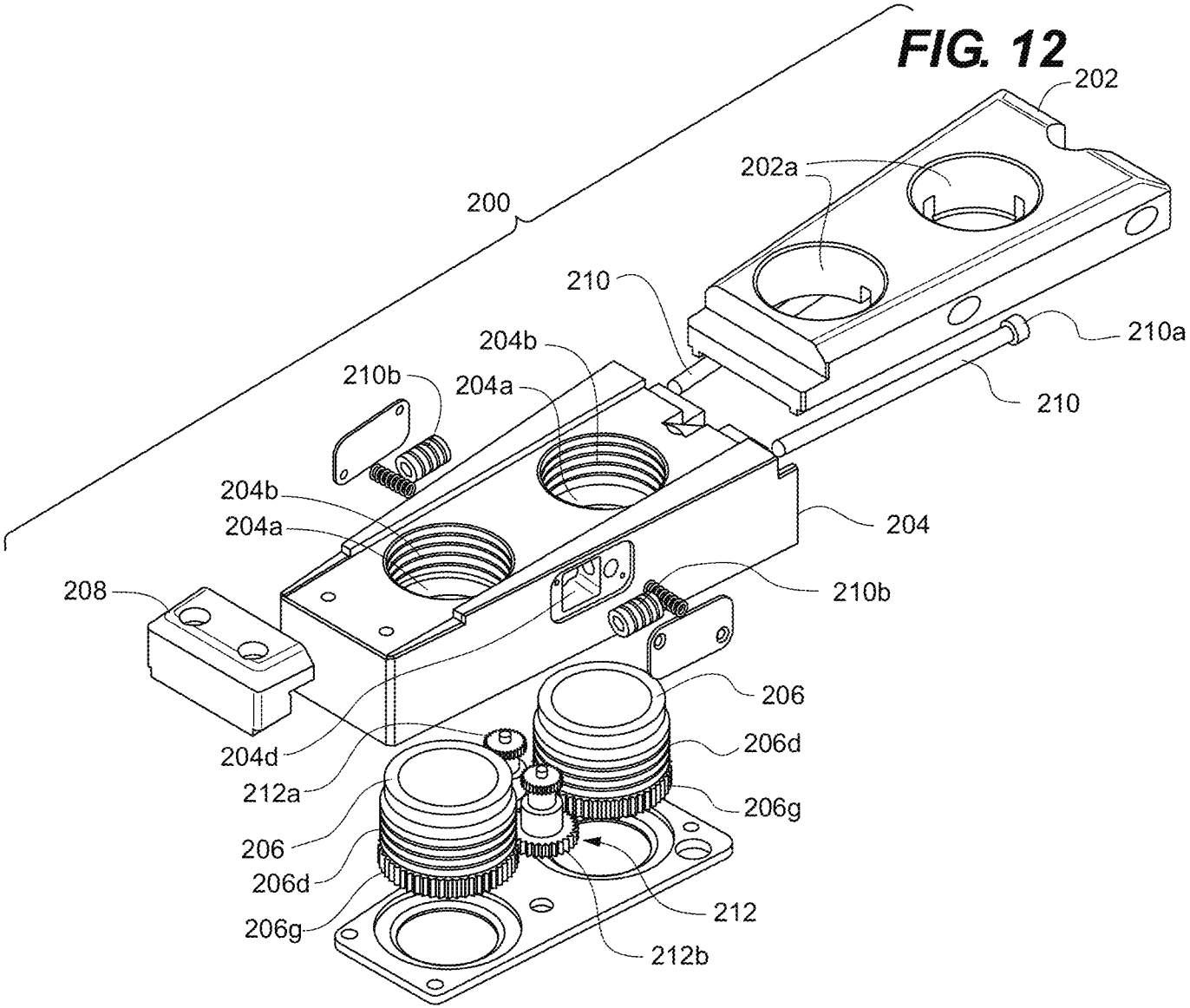
FIG. 12 is a representative exploded view of another die shoe assembly in accordance with certain embodiments of the invention, with the assembly configured for a first station type.
Figure 17:
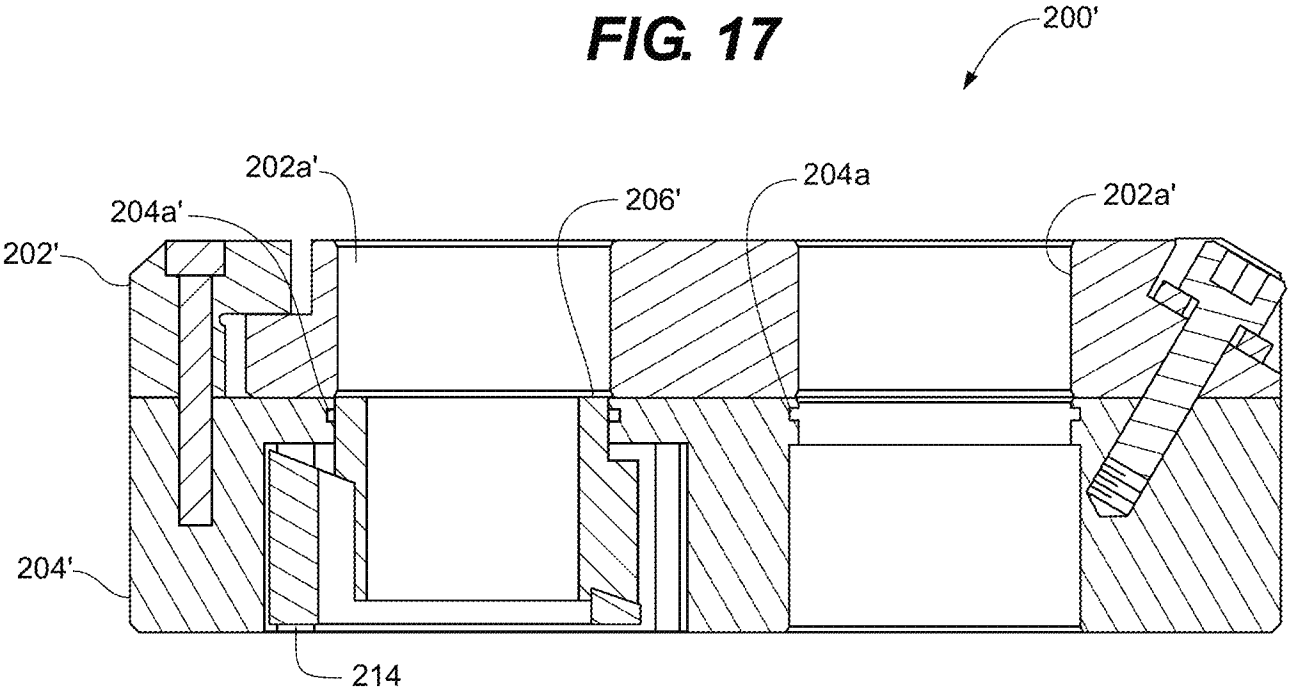
FIG. 17 is similar cross-sectional representative view of the die shoe assembly as shown in FIG. 16, alternatively depicting a second exemplary manner of connection to a die platform in accordance with certain embodiments of the invention.
Figure 18:
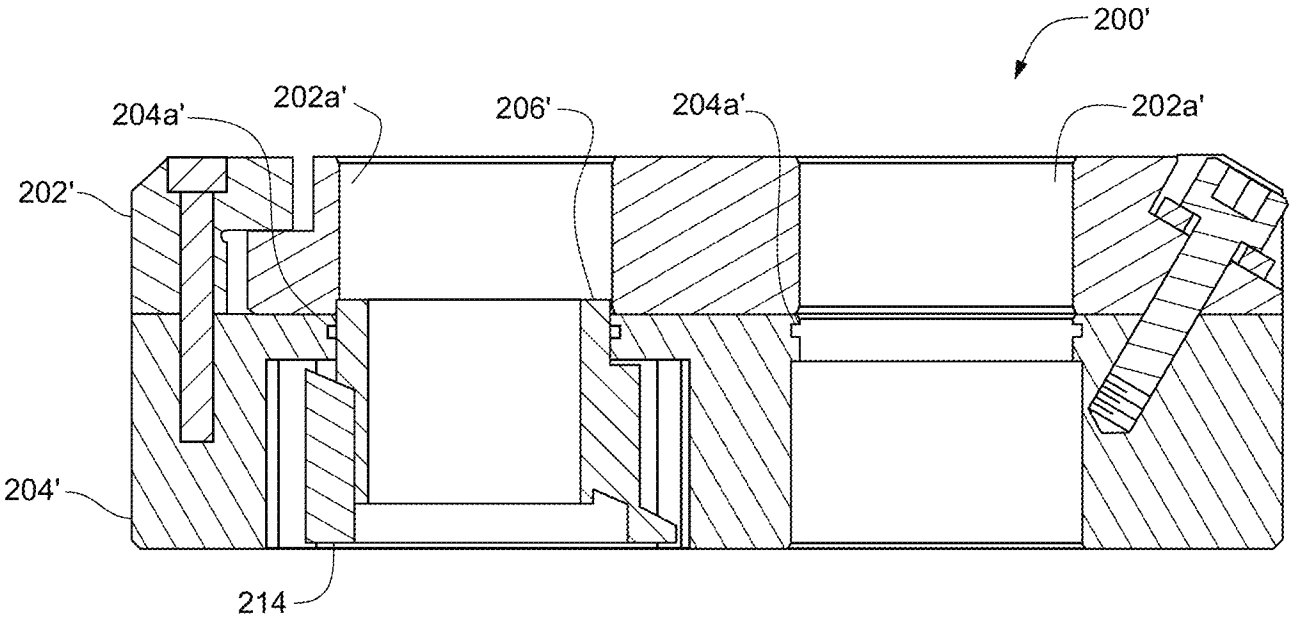
FIG. 18 is same cross-sectional view of the die shoe assembly as shown in FIG. 17, showing the die platform in a raised position in accordance with certain embodiments of the invention.

It should be appreciated from the die shoe assembly 200 of FIG. 12 (as well as the die shoe assembly 100 of FIG. 1 and the assembly 150 of FIG. 7) that the die platforms 206 each have a bottom position relative to the assembly 200, such that the only adjustment for the platform 206 from such bottom position is to be raised. Such position for the die platforms 206 would ideally be associated with new dies being used with the assembly 200, prior to the dies being sharpened (and reduced in height), although this may not always be the case. To this point, vertical adjustment of the die platforms 106, 106', and 206 of corresponding assemblies 100, 150, and 200 has been achieved via twisting of the platforms; however, twisting should be recognized as just one exemplary manner by which the warranted change/adjustment can be triggered, and not the only manner. To that end, FIGS. 17 and 18 provide an exemplary alternate configuration represented as die shoe assembly 200'. For instance, as shown in FIG. 17, a base 214 is defined about the die platform 206' and via shifting of the base 214 in single direction relative to the platform 206' (exemplarily shown in FIG. 18), the platform 206' can be correspondingly raised vertically within the assembly 200'. To that end, if the base 214 were to be shifted in opposite direction, the platform 206' can be correspondingly lowered within the assembly 200'.

Figure 19:
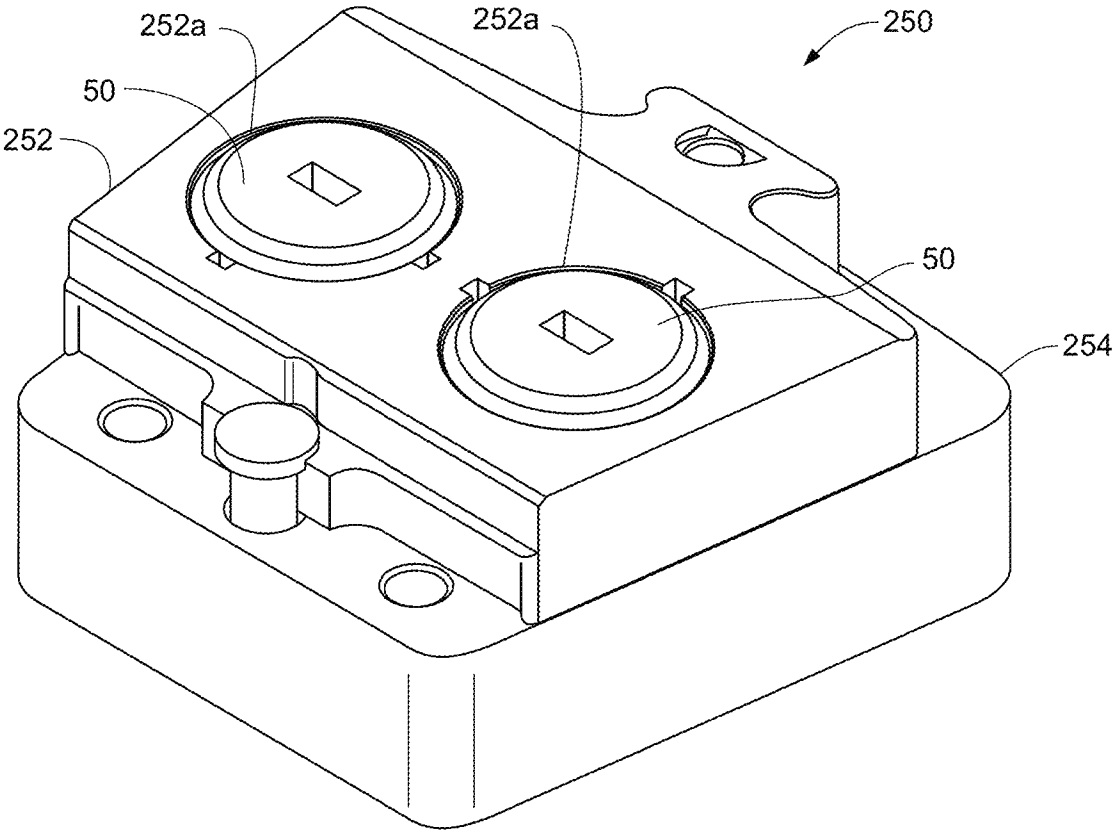
FIG. 19 is a perspective side view of a die shoe assembly having similarities to the design of FIG. 12 and configured for a third station type in accordance with certain embodiments of the invention.
Figure 21:
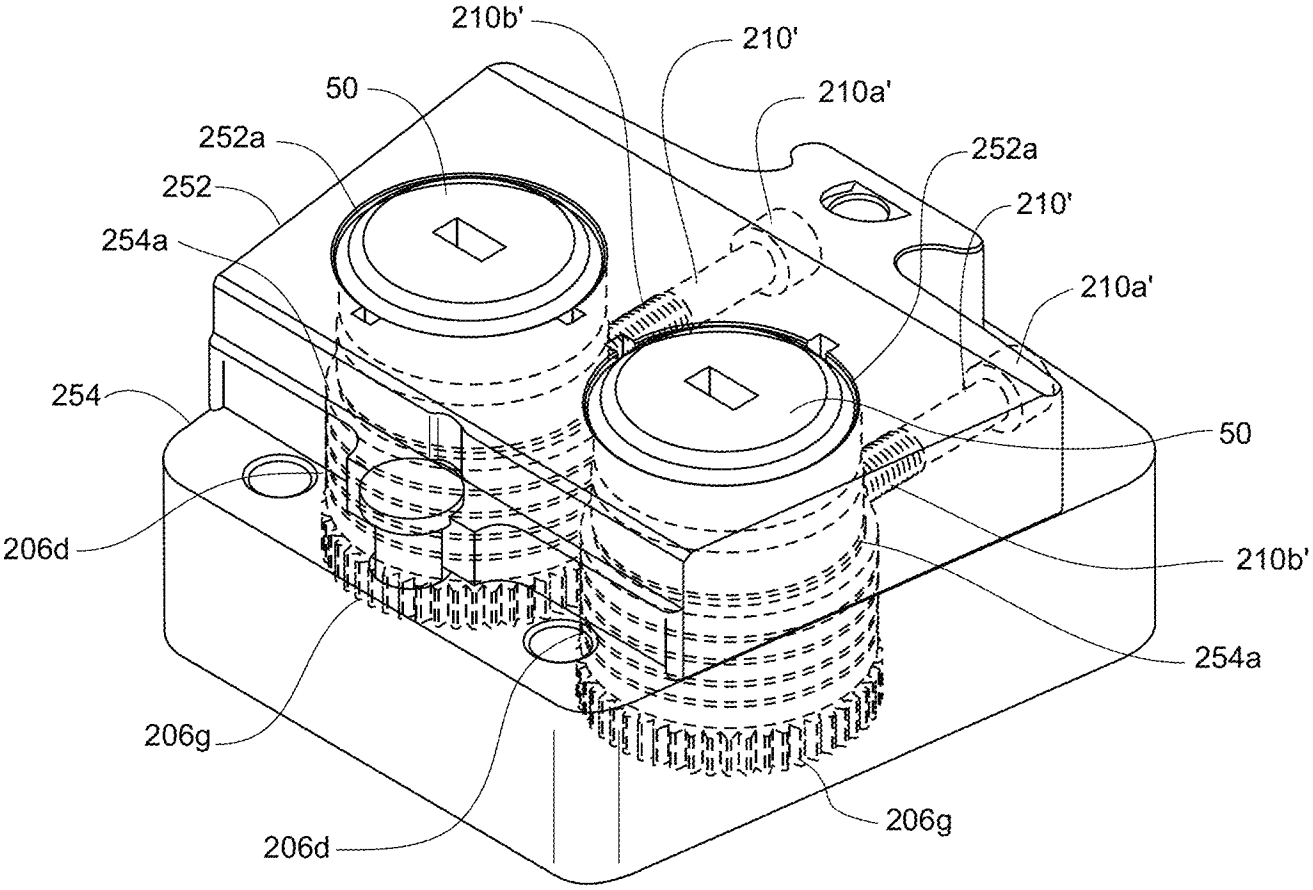
FIG. 21 is a transparent view of the die shoe assembly of FIG. 19.

FIG. 19 shows another die shoe assembly 250 in accordance with certain embodiments of the invention. Particularly, the assembly 250 has similarities to the assembly 200 of FIG. 12 yet is configured for a third mounting station type. To that end, and with reference to transparent view of FIG. 21, the assembly 250 includes a guide plate 252 defined with a pair of apertures 252*a* and a base 254 defined with a pair of recesses 254*a*, whereby the corresponding apertures and recesses align (when the assembly 250 is constructed) and are sized to receive die platforms 206 and correspondingly-sized dies 50 supported by the platforms 206. In contrast to other mounting station types embodied to this point, the die shoe assembly 250 is configured to support dies 50 positioned side by side, as opposed to inner and outer positioning as configured for assemblies 100, 150, and 200. Also, the die shoe assembly 250 is depicted with dies 50 therein, described later as to aspects of the assembly 250.

Figure 22:
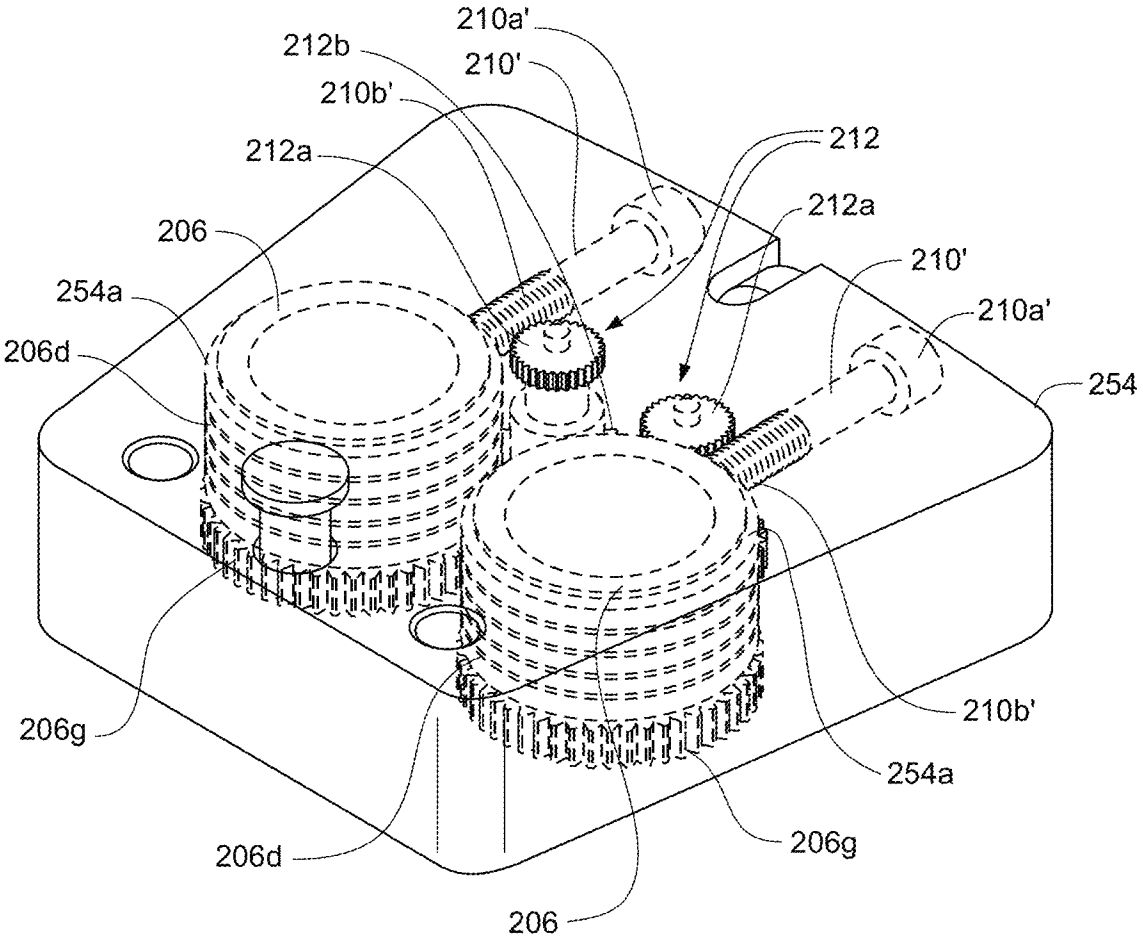
FIG. 22 is a transparent view of a base of the die shoe assembly of FIG. 19, showing an exemplary configuration of gear design in accordance with certain embodiments of the invention.

Similar to the assembly 200, the adjustment in vertical position of each die platform 206 is triggered via twisting of a corresponding feedthrough fastener 210' (via rotation of the head 210*a*' with a tool, e.g., Allen wrench). However, based on the side by side configuration of the assembly 250, the fasteners 210' can be shorter in length, as compared to the fasteners 210 used with the assembly 200 of FIG. 12. Keeping the assembly design compact can reduce overall cost of the assembly 250 while making the assembly 250 easier to handle and store. However, despite the difference in length, the fasteners 210' are configured to operate much the same as already described for the fasteners 210 of FIG. 12. Particularly, each of the fasteners 210', in certain embodiments, is operatively linked to one of the die platforms 206 via a gear assembly 212 of similar design as that already described for the assembly 200. To that end, and with reference to FIG. 22, the gear assembly 212 has interlinked first (upper) and second (lower) gears 212*a*, 212*b*, wherein one of the gears (e.g., the upper gear 212*a*) can be operatively connected to one of the fasteners 210' (e.g., via threaded insert 210*b*'), while the other gear (accordingly, the lower gear 212*b*) can be operatively connected to the corresponding die platform 206 (e.g., via ring gear 206*g*).

Figure 20:
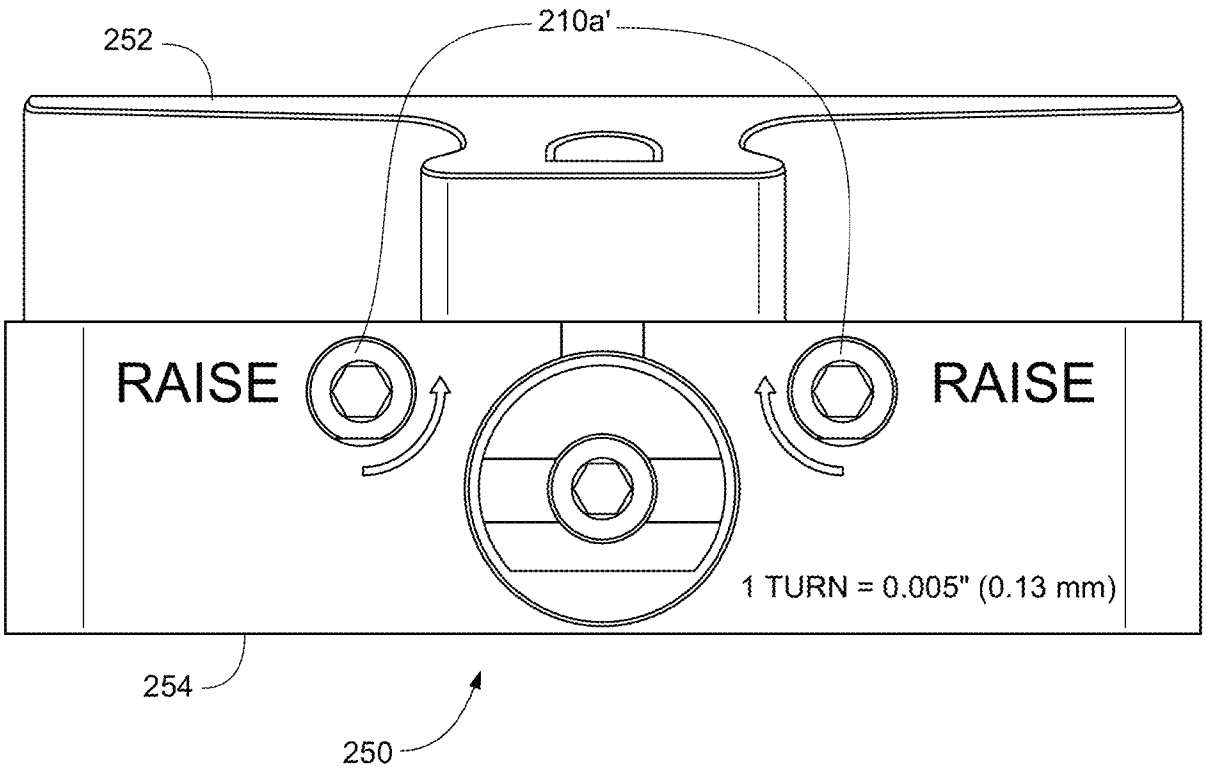
FIG. 20 is an elevation view of rear side of the die shoe assembly of FIG. 19.

Shifting to FIG. 20, showing an end of the assembly 252 from which heads 210*a*' of the fasteners 210' protrude, every complete turn of one of the fastener heads 210*a*' corresponds with an iteration of adjustment in vertical position (raising or lowering) of the corresponding die platform 206, which further results in corresponding adjustment in vertical position of the die 50 (positioned on the platform 206 and) used with the assembly 250. In certain embodiments, each iteration can represent 0.13 mm (0.005") shift in vertical position of the corresponding die platform 206 operably connected thereto.

Continuing with FIG. 20, relationship between rotation direction of the fastener heads 210*a*' and vertical position adjustment of the corresponding die platforms 206 is similar to that already described with the assembly 200. For instance, in one embodiment as shown, the fasteners 210' are positioned in front the die platforms 206' to which they are operatively connected. To that end, and as imprinted on the assembly end, for the fastener 210' protruding from left side of the assembly end, a counterclockwise twisting of the (head 210*a*' of the) fastener 210' would correspond with a raising of the corresponding platform 206 within its recess 254*a*, while a clockwise twisting of that same fastener 210' would correspond with a lowering of that platform 206 (provided the platform 206 is not at its bottom position). Then, relative to the other fastener 210' (protruding from right side of assembly end), a clockwise twisting of its head 210*a*' would correspond with a raising of its corresponding platform 206, while a counterclockwise twisting of that same fastener 210' would correspond with a lowering of that platform 206 within the assembly 250.

It should be appreciated relative to the die shoe assemblies 100, 150, 200, and 250 that each has certain aspects that could be viewed as particularly favorable. For example, with the assemblies 100 and 150, there are few components used with the die platforms 106 and 106' in order to adjust their vertical positioning within the assemblies 100, 150. Particularly, only the tool 112 is needed to make such adjustment, and during such adjustment (and with the use of the plungers 110 and the indentations 106*f*), the amount of adjustment can be effectively and accurately provided. Turning to the geared assemblies 200 and 250 (as well as assembly 300 of FIG. 23, still to be detailed), adjustment of vertical positioning of the die platforms 206 (206') can be provided with the dies positioned in the assemblies (as exemplified with the dies 50 shown in the assembly 250). In addition, during adjustment of vertical positioning of the die platforms 206 and 206', the amount of adjustment can be effectively and accurately provided.

Figure 23:
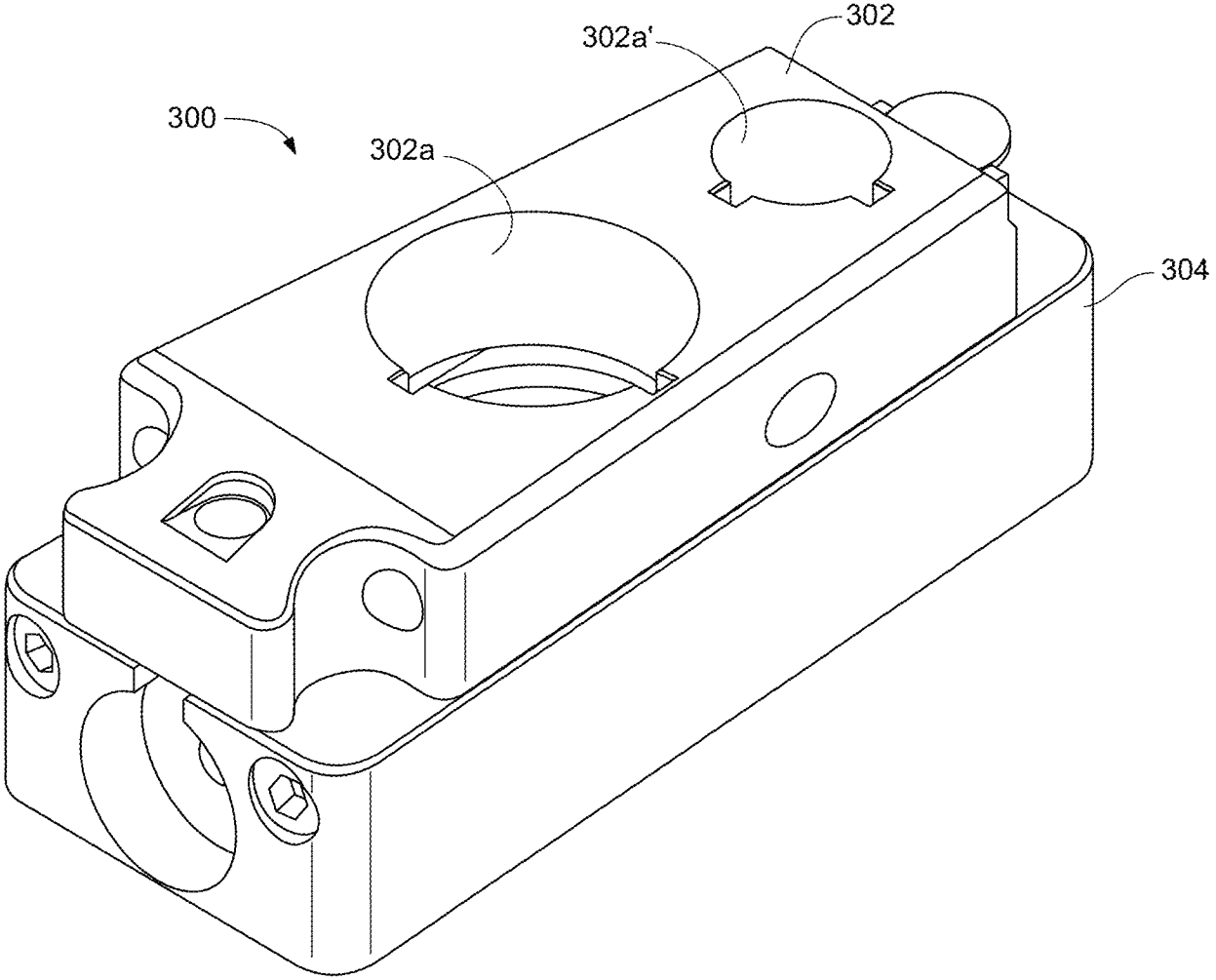
FIG. 23 is a perspective side view of a further die shoe assembly in accordance with certain embodiments of the invention, with the assembly configured for a second station type.
Figure 24:
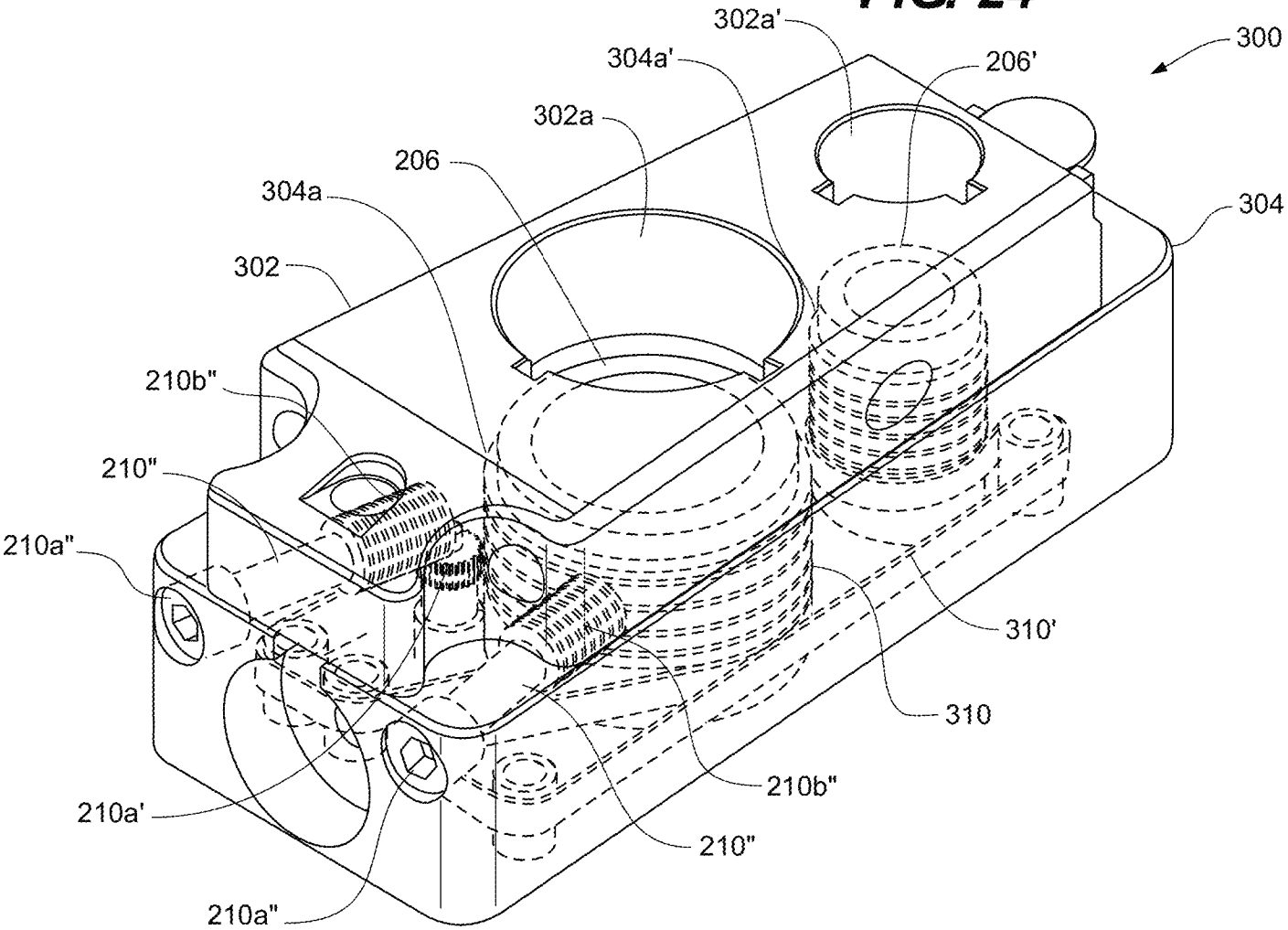
FIG. 24 is a transparent view of the die shoe assembly of FIG. 23.

FIG. 23 shows a further die shoe assembly 300 in accordance with certain embodiments of the invention. Particularly, the assembly 300 has similarities to the assembly 150 of FIG. 7 in that it is configured for second mounting station type and for differing sizes of die platforms 206, 206' and correspondingly differing sizes of dies. Additionally, the assembly 300 has similarities to the assembly 250 of FIG. 19 in that adjustment of the die platforms 206, 206' is triggered via shortened feedthrough fasteners 210'. With this as a backdrop, and with further reference to FIG. 23 as well as transparent view of FIG. 24, the assembly 300 includes a guide plate 302 defined with a pair of apertures 302*a* and 302*a'* and a base 304 defined with a pair of recesses 304*a* and 304*a'*, whereby the corresponding apertures and recesses align when the assembly 300 is constructed. With further reference to FIG. 23, each correspondingly aligned aperture and recess (302*a* and 304*a*, and 302*a'* and 304*a'*) of the assembly 300 are sized to receive correspondingly-sized die platforms 206 and 206'. Accordingly, the platforms 206 and 206' are configured to support different, yet correspondingly-sized dies (not shown) when used with the die shoe assembly 300.

Similar to the assemblies 200 and 250, the adjustment in vertical position of each die platform 206, 206' is triggered via twisting of a corresponding feedthrough fastener 210" (via rotation of the heads 210*a*" with a tool, e.g., Allen wrench). To that end, each of the fasteners 210", in certain embodiments, is operatively linked to one of the die platforms 206 via a gear assembly 212' of similar design as that already described for the assemblies 200 and 250. To that end, and with reference to FIGS. 25 and 26, the gear assembly 212' has interlinked gear 212*a'* and roller 212*c*, wherein the gear 212*a'* (e.g., provided on upper portion of gear assembly 212') is operatively connected to one of the fasteners 210" (e.g., via threaded insert 210*b*"), while the roller 212*c* (accordingly, provided on lower portion of gear assembly 212') is operatively connected to the corresponding die platform 206 or 206' (e.g., via belts 310 or 310').

Figure 25:
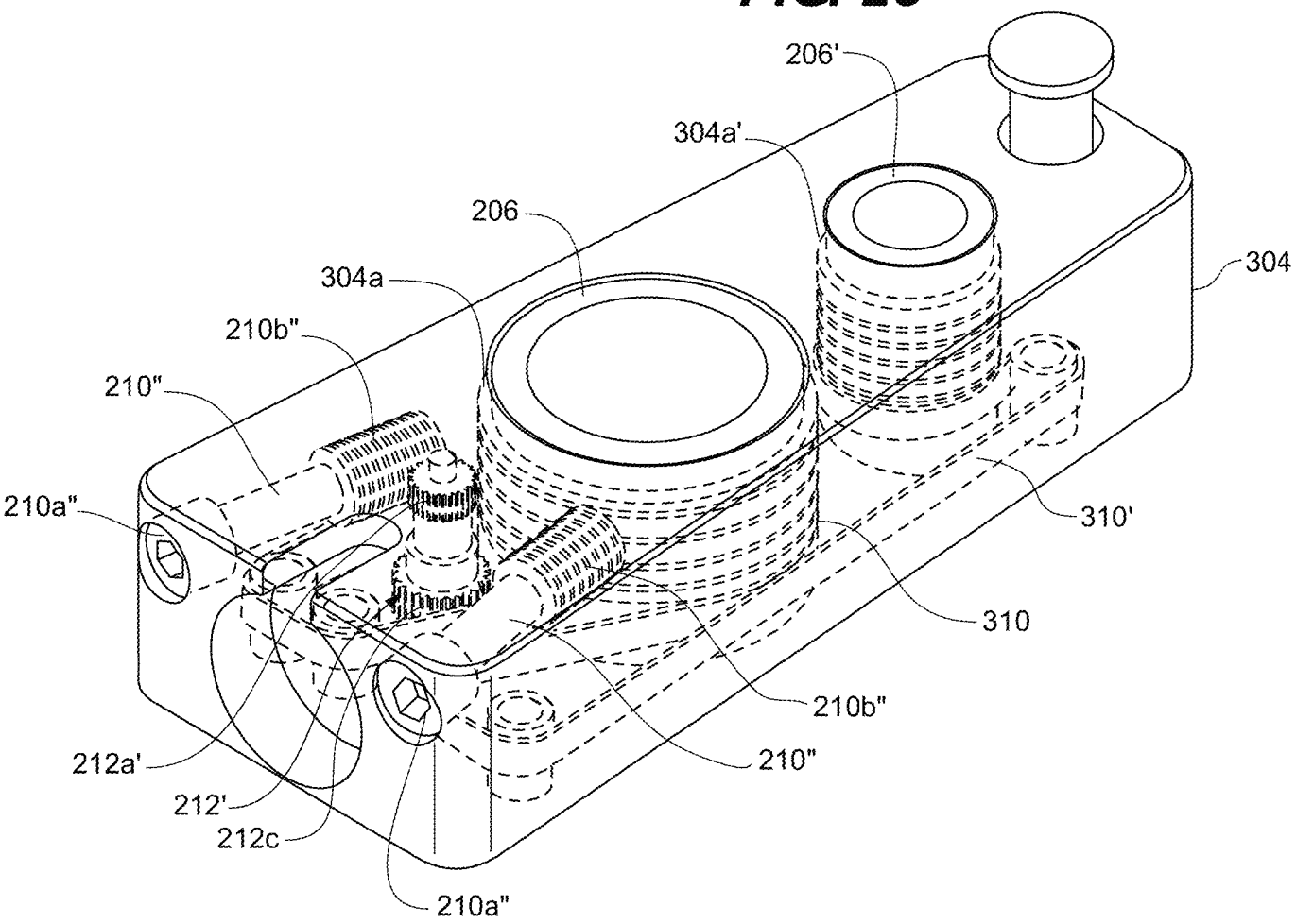
FIG. 25 is a transparent view of a base of the die shoe assembly of FIG. 23.

With further reference to FIG. 25, every complete turn of one of the fastener heads 210*a*" corresponds with an iteration of adjustment in vertical position (raising or lowering) of the corresponding die platform 206 or 206', which further results in corresponding adjustment in vertical position of die (positioned on the platform 206 or 206' and) used with the assembly 300. In certain embodiments, each iteration can represent 0.13 mm (0.005") shift in vertical position of the corresponding die platform operably connected thereto.

Figure 26:
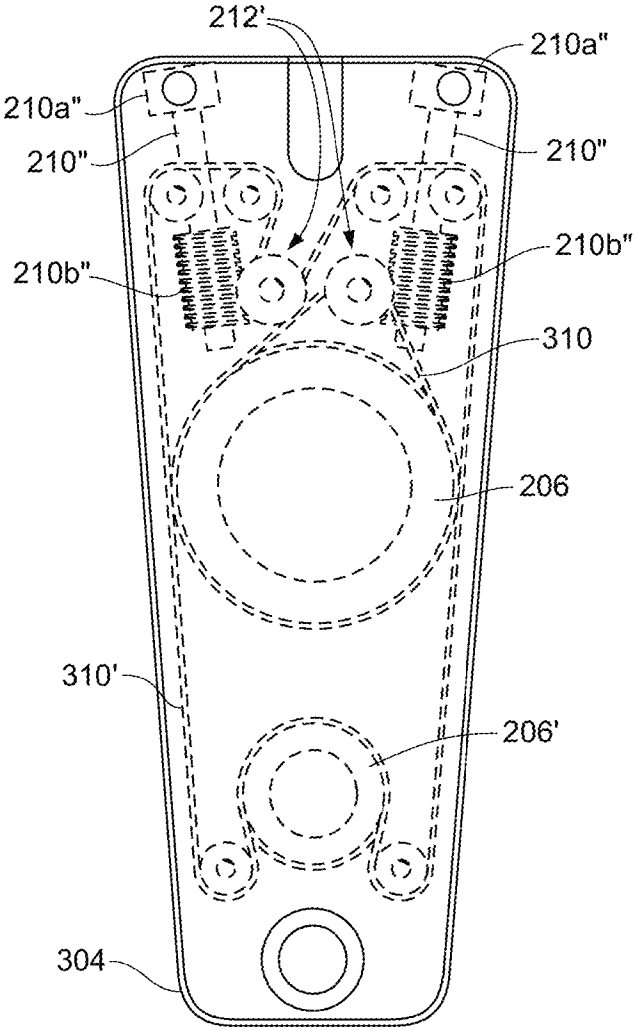
FIG. 26 is a top view of the base as shown in FIG. 25, showing an exemplary configuration of belt design in accordance with certain embodiments of the invention.

Continuing with FIG. 25 and with reference to FIG. 26, relationship between the fasteners 210" and rotation direction of their fastener heads 210*a*" with respect to vertical height adjustment of the corresponding die platforms 206, 206' is similar to that already described with the assemblies 200 and 250. The relationship between rotation direction of the fastener heads 210*a*" and adjustment to the corresponding die platforms 206, 206' can depend on placement of the fasteners 210" relative to their corresponding die platforms 206, 206'. For instance, in one embodiment (perhaps best shown relative to FIG. 26), a counterclockwise twisting of the (head 210*a*" of the) fastener 210" linked to the closer (or outer) die platform 206 of the assembly 300 would correspond with a raising of that platform 206, while a clockwise twisting of that same fastener 210" would correspond with lowering of that platform 206 within the assembly 300.

Then, relative to the other fastener 210" (protruding from other side of assembly end) linked to the farther (or inner) die platform 206', a clockwise twisting of the fastener 210" (via its head 210*a*") would correspond with a raising of that platform 206', while a counterclockwise twisting of that same fastener 210" would correspond with a lowering of that platform 206' within the assembly 300.

Thus, embodiments of a DIE SHOE ASSEMBLIES CONFIGURED FOR SHIMLESS ADJUSTMENT are disclosed. One skilled in the art will appreciate that the invention can be practiced with embodiments other than those disclosed. The disclosed embodiments are presented for purposes of illustration and not limitation, and the invention is limited only by the claims that follow.

What is claimed is:

1. A die shoe assembly, the assembly comprising:

a guide plate, a base, and one or more die platforms;

the guide plate defining a quantity of apertures therein and the base defining a quantity of recesses therein, the quantity of apertures and the quantity of recesses each corresponding to quantity of the one or more die platforms, the guide plate adjoined atop the base with the apertures and the recesses being aligned and sized to correspondingly receive the one or more die platforms, the one or more die platforms adjustably coupled within the corresponding recesses and selectively adjustable vertically relative to the base and the guide plate;

wherein the one or more die platforms are sized to support dies correspondingly received within the apertures, at least one of the die platforms being selectively adjustable via use of a mechanism, the mechanism configured to adjust the at least one die platform via a single action, whereby the single action results in a corresponding adjustment in vertical position of the at least one die platform relative to the base and the guide plate as well as a corresponding adjustment in vertical position of a die when supported by the at least one die platform; and wherein the at least one die platform is defined with a plurality of indentations about an outer periphery thereof; and further comprising a plurality of plungers received in a corresponding plurality of through-holes extending into the aperture or the recess corresponding to the at least one die platform, such that the plungers can protrude into a corresponding plurality of the indentations to maintain position of the at least one die platform.

2. The assembly of claim 1 wherein the guide plate defines two apertures and the base defines two recesses, the two apertures respectively paired and aligning with the two recesses for receiving a corresponding two die platforms.

3. The assembly of claim 2 wherein the two apertures, the two recesses, and the two die platforms are in an inner and outer configuration relative to mounting type of the die shoe assembly.

4. The assembly of claim 1 wherein the mechanism is a handheld tool that is independent from the die shoe assembly, the mechanism being directly engageable with the at least one die platform for adjustment thereof.

5. The assembly of claim 4 wherein the at least one die platform is defined with a central cavity within which an end of the tool is engageable for adjustment of the at least one die platform.

6. The assembly of claim 5 wherein the central cavity is defined with one or more notches to mate with a corresponding one or more fins protruding from the engaging end of the tool.

7. The assembly of claim 1 wherein the single action is a twisting of the tool, with the corresponding adjustment by the at least one die platform being a rotation within the corresponding at least one recess and the plurality of plungers moving between the indentations, wherein each shift of the plungers from one of the indentations to a neighboring of the indentations represents a quantifiable iteration of adjustment in vertical position of the at least one die platform relative to the base and the guide plate.

8. The assembly of claim 7 wherein the quantifiable iteration of adjustment is signaled via a clicking sound, from contact with and subsequent passing over a raised portion between the neighboring indentations.

9. The assembly of claim 7 wherein the quantifiable iteration of adjustment is signaled via force opposing the twisting of the tool, from contact with and subsequent passing over a raised portion between the neighboring indentations.

10. The assembly of claim 1 wherein the mechanism is a feedthrough fastener integrated within the die shoe assembly, the mechanism being indirectly linked with the at least one die platform for adjustment thereof.

11. The assembly of claim 10 wherein the fastener is indirectly linked with the at least one die platform via a gear assembly, the gear assembly having interconnected gears, a first gear operably linked to the fastener and a second gear operably linked to the at least one die platform.

12. The assembly of claim 10 wherein the fastener is indirectly linked with the at least one die platform via a belt.

13. The assembly of claim 10 wherein the single action is a twisting of the fastener, with the corresponding adjustment by the at least one die platform being a rotation within a corresponding at least one of the recesses, wherein each complete rotation of the fastener represents a quantifiable iteration of adjustment in vertical position of the at least one die platform relative to the base and the guide plate.

14. The die shoe assembly of claim 1 wherein the at least one die platform has an outer threading adapted to mate with an inner threading defining a corresponding one of the recesses of the base, the at least one die platform when adjusted being correspondingly raised or lowered within the inner threading.

15. The assembly of claim 14 wherein the single action is a twisting of the mechanism, with the corresponding adjustment by the at least one die platform being a rotation within the inner threading.

16. A die shoe assembly, the assembly comprising:

a guide plate, a base, and one or more die platforms;

the guide plate defining a quantity of apertures therein and the base defining a quantity of recesses therein, the quantity of apertures and the quantity of recesses each corresponding to quantity of the one or more die platforms, the guide plate adjoined atop the base with the apertures and the recesses being aligned and sized to correspondingly receive the one or more die platforms, the one or more die platforms adjustably coupled within the corresponding recesses and selectively adjustable vertically relative to the base and the guide plate;

wherein the one or more die platforms are sized to support dies correspondingly received within the apertures, at least one of the die platforms being selectively adjustable via use of a mechanism, wherein a defined extent of adjustment of the mechanism represents a quantifiable iteration of adjustment in vertical position of the at least one die platform relative to the base and the guide plate as well as a corresponding adjustment in vertical position of a die when supported by the at least one die platform wherein the at least one die platform is defined with a plurality of indentations about an outer periphery thereof; and further comprising a plurality of plungers received in a corresponding plurality of through-holes extending into the aperture or the recess corresponding to the at least one die platform, such that the plungers can protrude into a corresponding plurality of the indentations to maintain position of the at least one die platform.

17. The assembly of claim 16 wherein the at least one die platform has an outer threading adapted to mate with an inner threading defining a corresponding at least one of the recesses of the base, wherein the mechanism is adjustably rotatable, whereby the mechanism being rotated results in a corresponding rotation of the at least one die platform within the inner threading, wherein a defined extent of rotation of the mechanism represents a quantifiable iteration of adjustment in vertical position of the at least one die platform relative to the inner threading.

18. The assembly of claim 16 wherein the mechanism is a handheld tool that is independent from the die shoe assembly, the mechanism being directly engageable with the at least one die platform for adjustment thereof.

19. The assembly of claim 16 wherein the mechanism is a feedthrough fastener integrated within the die shoe assembly, the mechanism being indirectly linked with the at least one die platform for adjustment thereof.

20. A method of adjusting vertical position of a die, the method comprising steps of:

providing a die shoe assembly comprising a guide plate, a base, and one or more die platforms, the guide plate defining a quantity of apertures therein and the base defining a quantity of recesses therein, the quantity of apertures and the quantity of recesses each corresponding to quantity of the one or more die platforms, the guide plate adjoined atop the base with the apertures and the recesses being aligned and sized to correspondingly receive the one or more die platforms, the one or more die platforms adjustably coupled within corresponding of the recesses and sized to support dies correspondingly received within the apertures;

selectively adjusting a mechanism engaged to at least one of the die platforms to correspondingly adjust the at least one die platform to a warranted vertical position relative to the base and the guide plate;

wherein the at least one die platform is defined with a plurality of indentations about an outer periphery thereof; and further comprising a plurality of plungers received in a corresponding plurality of through-holes extending into the aperture or the recess corresponding to the at least one die platform, such that the plungers can protrude into a corresponding plurality of the indentations to maintain position of the at least one die platform.

21. The method of claim 20 wherein the mechanism is adjusted to a defined extent of adjustment which represents a quantifiable iteration of adjustment in vertical position of the at least one die platform relative to the base and the guide plate as well as a corresponding adjustment in vertical position of a die when supported by the at least one die platform.

22. The method of claim 20 wherein the mechanism is rotatably adjustable, whereby the mechanism being rotated results in a corresponding rotation of the at least one die platform within the inner threading, wherein a defined extent of rotation of the mechanism represents a quantifiable iteration of adjustment in vertical position of the at least one die platform relative to the inner threading.

23. The method of claim 20, wherein the adjustment is performable with a die on the at least one platform.

* * * * *